US008327789B2

(12) United States Patent
Emch

(10) Patent No.: US 8,327,789 B2
(45) Date of Patent: Dec. 11, 2012

(54) BARGE PUSHER

(75) Inventor: Jeffrey J. Emch, Butler, IN (US)

(73) Assignee: Mid-America Foundation Supply Inc., Fort Wayne, IN (US)

( * ) Notice: Subject to any disclaimer, the term of this patent is extended or adjusted under 35 U.S.C. 154(b) by 11 days.

(21) Appl. No.: 12/953,773

(22) Filed: Nov. 24, 2010

(65) Prior Publication Data

US 2012/0125248 A1 May 24, 2012

(51) Int. Cl.

| | |
|---|---|
| ***B63B 35/38*** | (2006.01) |
| ***B63B 3/02*** | (2006.01) |
| ***B63B 3/08*** | (2006.01) |
| ***B63B 21/56*** | (2006.01) |
| ***B63B 35/70*** | (2006.01) |
| ***B63H 5/125*** | (2006.01) |
| ***B63H 21/165*** | (2006.01) |
| ***B63H 23/26*** | (2006.01) |
| ***B63H 25/42*** | (2006.01) |

(52) U.S. Cl. ..... 114/266; 114/26; 114/77 R; 114/246; 114/249; 440/5; 440/53; 440/54; 440/61 S

(58) Field of Classification Search ..... 114/26–38, 114/77 R, 77 A, 242, 246, 248–252, 266, 114/267; 440/53, 54, 60, 61 S–61 C, 5
See application file for complete search history.

(56) References Cited

U.S. PATENT DOCUMENTS

| | | | | |
|---|---|---|---|---|
| 2,668,679 A | | 2/1954 | Harneit | |
| 3,422,780 A | * | 1/1969 | Becker et al. | 114/77 R |
| 3,483,843 A | * | 12/1969 | Hawthorne | 440/54 |
| 3,508,514 A | * | 4/1970 | Vienna | 114/248 |
| 3,602,869 A | | 8/1971 | Metz et al. | |
| 3,650,238 A | * | 3/1972 | Stockdale | 114/249 |
| 3,938,461 A | * | 2/1976 | Marriner | 114/249 |
| 4,143,614 A | | 3/1979 | Jeanson et al. | |
| 4,358,280 A | | 11/1982 | Jeanson et al. | |
| 4,615,546 A | | 10/1986 | Nash et al. | |
| 4,738,463 A | | 4/1988 | Poore et al. | |
| 4,878,864 A | | 11/1989 | Van Bentem | |

(Continued)

FOREIGN PATENT DOCUMENTS

GB 2173744 A * 10/1986

(Continued)

*Primary Examiner* — Ajay Vasudeva
(74) *Attorney, Agent, or Firm* — Faegre Baker Daniels LLP

(57) ABSTRACT

A sectional barge assembly and a hydraulic thruster apparatus for maneuvering the sectional barge assembly. The hydraulic thruster apparatus includes a hydraulic power unit and a thruster unit. The hydraulic power unit includes an engine and a hydraulic pump connected to the engine. The thruster unit includes a hydraulic motor and a propeller drivingly connected to the hydraulic motor to provide a thrust force that acts to move the sectional barge assembly. The sectional barge assembly includes a plurality of barges interconnected by connector devices that are also used to interconnect the thruster unit to the sectional barge assembly. Further, a hydraulic connection panel is mounted on the thruster unit and includes a plurality of hydraulic connectors which allow a plurality of hydraulic lines to be removably connectable thereto, respectively. By this arrangement, the hydraulic pump provides pressurized hydraulic fluid through the hydraulic lines thereto the hydraulic motor and other components of the thruster unit. Additionally, the thruster unit includes at least one hydraulic cylinder for controlling vertical rectilinear sliding of a thruster unit mast between a top position and a bottom position. The thruster unit also includes a rotating mechanism for rotating the mast and a propeller assembly of the thruster unit about a longitudinal axis of the mast.

6 Claims, 17 Drawing Sheets

U.S. PATENT DOCUMENTS 5,479,869 A * 1/1996 Coudon et al. ..... 114/26
6,182,593 B1 * 2/2001 Wierick ..... 114/249
6,375,524 B1 4/2002 Commandeur et al.
6,672,236 B1 1/2004 Pinsof
6,799,528 B1 10/2004 Bekker
6,848,382 B1 2/2005 Bekker
7,654,875 B1 2/2010 Williams
7,669,541 B2 * 3/2010 Horton et al. ..... 114/266
7,883,384 B1 * 2/2011 Williams ..... 440/5

FOREIGN PATENT DOCUMENTS

JP 62241791 A * 10/1987

* cited by examiner

BARGE PUSHER

BACKGROUND

1. Technical Field

The present disclosure relates to a barge propulsion system.

2. Description of the Related Art

Barges are commonly used on waterways during large construction projects to support heavy equipment. In order to maneuver the barge and the heavy equipment into a desired position, hydraulic thruster units are used. Hydraulic thrusters may be formed as self-contained units that are readily mountable to and removable from individual barges.

Existing hydraulic thruster units contain a single unit having a power component and a propeller component that are not easily disconnected from each other. The problem with these existing designs is that the locations on the barge where the propeller component can be positioned are limited. Further, it is difficult to transport both the power component and the propeller component together to a desired construction project.

SUMMARY

The present disclosure provides a hydraulic thruster apparatus for maneuvering a marine vessel. In one aspect of the present disclosure, the hydraulic thruster apparatus comprises a hydraulic power unit positionable on a deck of the marine vessel and a thruster unit connectable to the marine vessel. The hydraulic power unit includes an engine and a hydraulic pump connected to the engine. The thruster unit includes a frame removably connectable to the marine vessel and a propeller assembly connected to the frame. The propeller assembly includes a hydraulic motor and a propeller drivingly connected to the hydraulic motor. The propeller provides a thrust force that acts to move the marine vessel. The thruster unit further comprises a rotating mechanism for rotating the propeller assembly about a generally vertical axis relative to the frame and a raising and lowering mechanism for controlling vertical rectilinear sliding of said propeller assembly relative to said frame. The hydraulic thruster apparatus further comprises a hydraulic connection panel mounted on the thruster unit, wherein at least one of the hydraulic motor, the rotating mechanism, and the raising and lowering mechanism is hydraulically connected to the hydraulic power unit by way of the hydraulic connection panel. In another aspect of the present disclosure, at least two of the hydraulic motor, the rotating mechanism, and the raising and lowering mechanism are hydraulically connected to the hydraulic power unit by way of the hydraulic connection panel. In another embodiment, all three of the hydraulic motor, the rotating mechanism, and the raising and lowering mechanism are hydraulically connected to the hydraulic power unit by way of the hydraulic connection panel.

In an exemplary embodiment, the hydraulic power unit comprises a plurality of first hydraulic lines in fluid communication with the hydraulic pump and the thruster unit comprises a plurality of second hydraulic lines in fluid communication with at least one of the hydraulic motor, the rotating mechanism, and the raising and lowering mechanism, the first hydraulic lines connected to at least some of the second hydraulic lines through the connection panel. In one embodiment, the hydraulic connection panel includes a support member having a plurality of first hydraulic connectors and a plurality of second hydraulic connectors, the first hydraulic lines removably connectable to the first hydraulic connectors, respectively, and the second hydraulic lines connectable to the second hydraulic connectors, respectively. By this arrangement, the hydraulic pump provides pressurized hydraulic fluid through the first hydraulic lines and the second hydraulic lines to at least one of the hydraulic motor, the rotating mechanism, and the raising and lowering mechanism. In another aspect of the present disclosure, at least the first hydraulic connectors are quick connect fittings capable of being connected and disconnected without the use of tools.

In another aspect of the present disclosure, there is provided a combination including a sectional barge assembly and a thruster unit for maneuvering the sectional barge assembly. The sectional barge assembly includes a first barge and a second barge, a plurality of first connection elements on the first barge, a plurality of second connection elements on the second barge aligned with the plurality of first connection elements, and connector devices of a certain configuration interconnecting the plurality of first connection elements and the plurality of second connection elements, respectively, to thereby connect the first barge and the second barge together. In this embodiment, the thruster unit includes a frame, a motor, and a propeller drivingly connected to the motor. Further, the thruster unit includes a thruster unit connection element on the frame compatible with the connector devices. In this arrangement, a connector device having said certain configuration also interconnects a barge connection element and the thruster unit connection element to thereby connect the thruster unit to the sectional barge assembly. In one embodiment, the connector devices comprise a Poseidon I connector device, which is compatible with a Rendrag® type barge. In another embodiment, the connector devices comprise a Poseidon II connector device, which is compatible with a Flexifloat® type barge.

In yet another aspect of the present disclosure, there is provided a combination including a barge and a thruster unit assembly for maneuvering the barge. The barge being adapted to be connected to other barges by means of either a connector device of a first configuration or a connector device of a second configuration different from the first configuration and having a plurality of barge connection elements positioned along its periphery. The thruster unit includes a frame, a motor, a propeller drivingly connected to the motor, and a plurality of thruster unit connection elements on the frame. By this arrangement, the thruster unit is connected to an end wall or a side wall of the barge by means of a first connector device of the first configuration or a second connector device of the second configuration that respectively engages the barge connection elements on the barge and the thruster unit connection elements on the frame.

In another aspect of the present disclosure, there is provided a combination including a barge and a thruster unit for maneuvering the barge. The barge includes an upper surface and a bottom surface. The thruster unit includes a frame removably connectable to the barge and a mast slidably connected to the frame. By this arrangement, the mast is slidable vertically rectilinearly between a top position and a bottom position. The thruster unit further includes a propeller assembly connected to the mast, and the propeller assembly includes a motor and a propeller drivingly connected to the motor. Further, the thruster unit includes a raising and lowering mechanism for controlling vertical rectilinear sliding of the mast relative to the frame between the top position and the bottom position. In an exemplary embodiment, with the mast in the top position the propeller is above the bottom surface of the barge, and with the mast in the bottom position the propeller is just below the bottom surface of the barge. In one embodiment, the raising and lowering mechanism comprises at least one hydraulic cylinder connected to the frame.

In another aspect of the present disclosure, there is provided a thruster unit for maneuvering a marine vessel comprising a frame removably connectable to the marine vessel, a mast rotatably connected to the frame, and a propeller assembly connected to the mast. The propeller assembly includes a motor and a propeller drivingly connected to the motor. Further, the thruster unit includes a rotating mechanism rotatably connected to and vertically supported on the frame, the mast engaged with the rotating mechanism for rotation therewith and rectilinear sliding relative thereto. In an exemplary embodiment, the rotating mechanism, the mast, and the propeller assembly rotate together about a longitudinal axis of the mast. In one embodiment, the rotating mechanism comprises a turntable bearing assembly.

BRIEF DESCRIPTION OF THE DRAWINGS

The above-mentioned and other features and advantages of this invention, and the manner of attaining them, will become more apparent and the invention itself will be better understood by reference to the following descriptions of embodiments of the invention taken in conjunction with the accompanying drawings, wherein.

Corresponding reference characters indicate corresponding parts throughout the several views. The exemplifications set out herein illustrate exemplary embodiments of the invention, and such exemplifications are not to be construed as limiting the scope of the invention in any matter.

DETAILED DESCRIPTION

Figure 4:
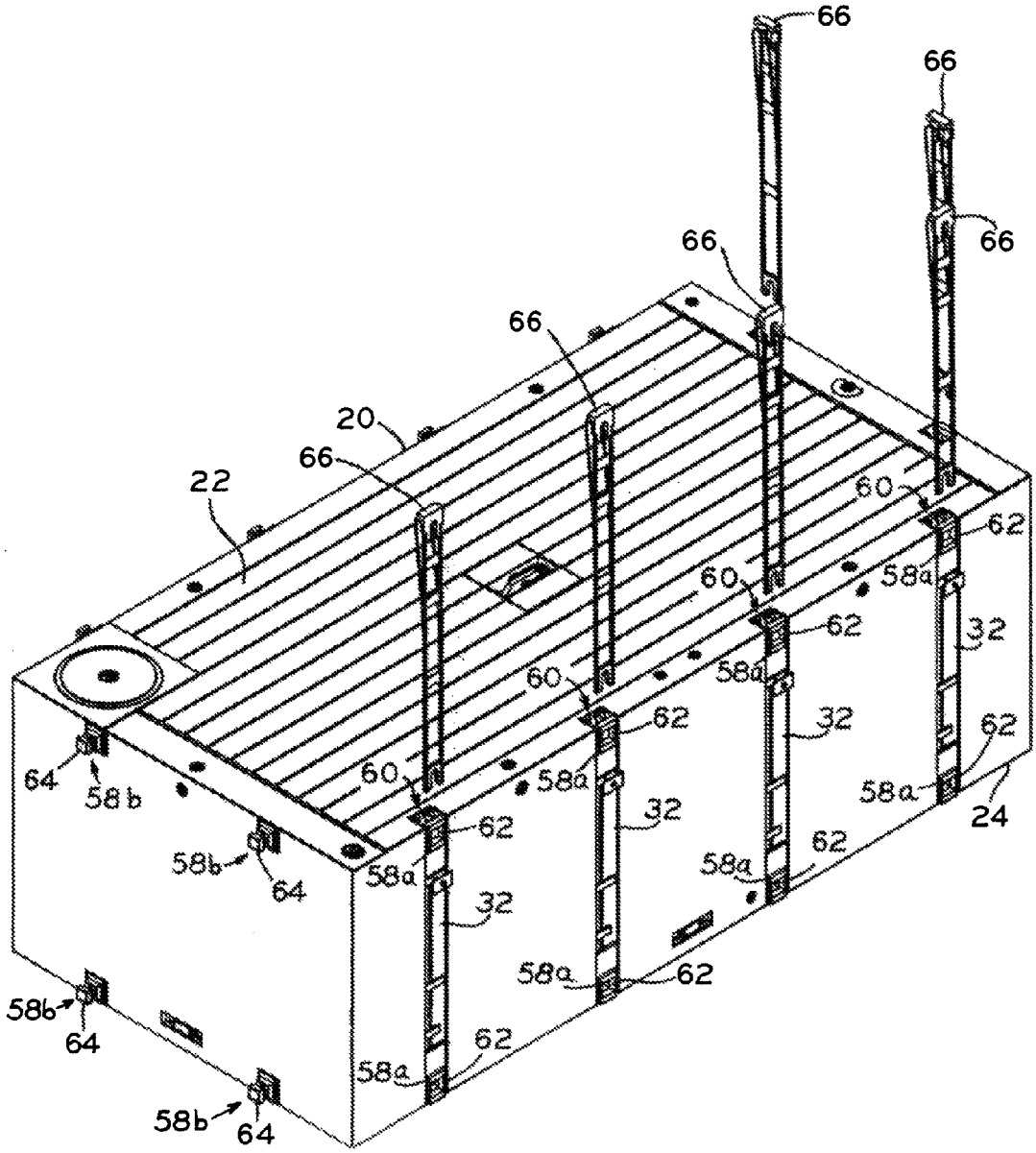
FIG. 4 is a perspective view of a sectional barge in accordance with another exemplary embodiment of the present disclosure.

The present disclosure provides a barge construction pusher unit that is readily mountable to and removable from an individual barge. Such a barge pusher unit is used to maneuver a barge on a waterway into a desired position at a construction site. The barge pusher unit can be used with a single barge as illustrated in FIG. 4, for example, or two or more barges connected together as illustrated in FIG. 1.

Figure 1:
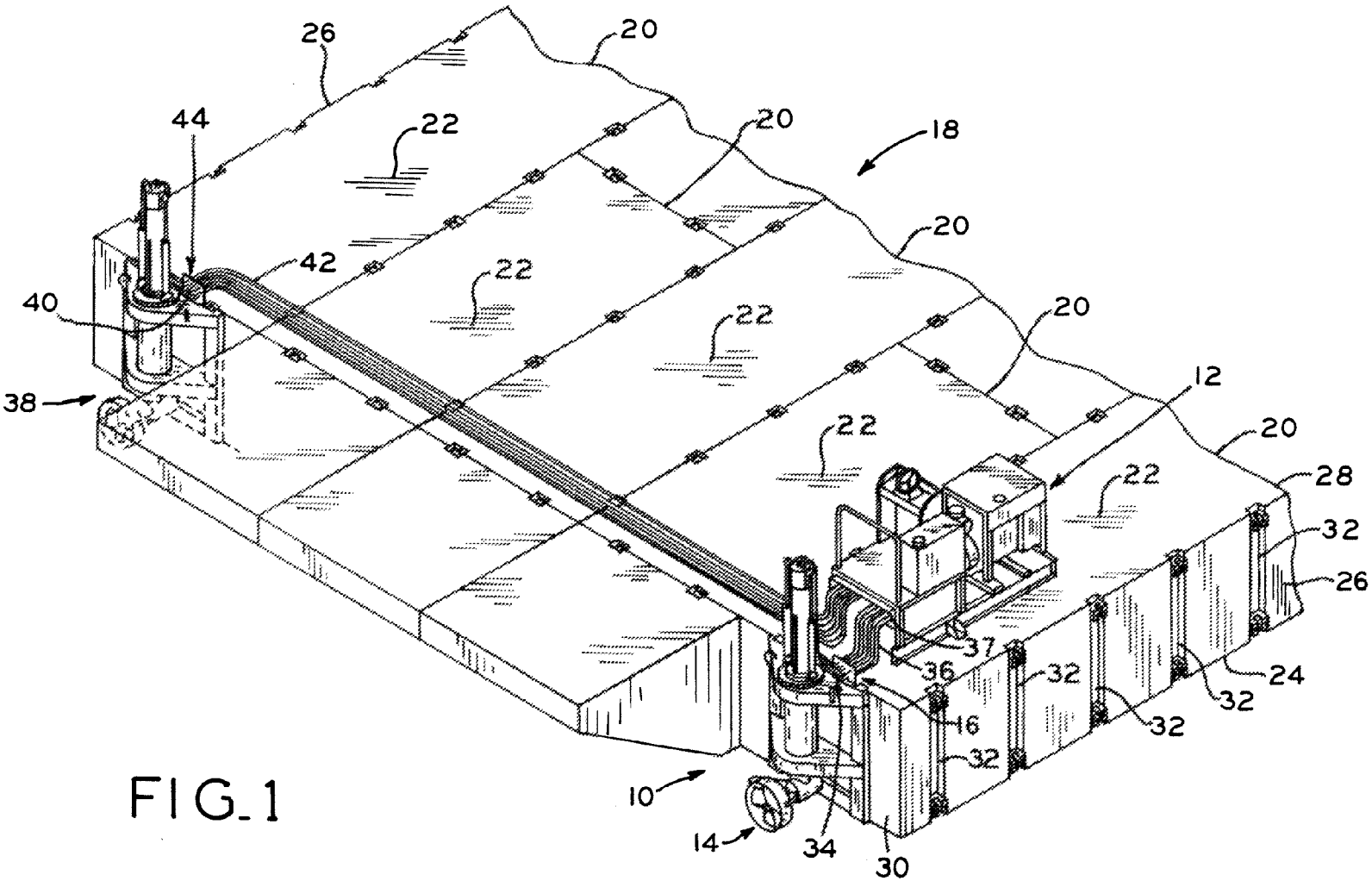
FIG. 1 is a perspective view of a sectional barge assembly and a barge pusher unit in accordance with the present disclosure.

FIG. 1 illustrates barge pusher unit 10 according to an exemplary embodiment of the present disclosure. In the exemplary embodiment of FIG. 1, barge pusher unit 10 includes hydraulic power unit 12, thruster unit 14, and thruster unit connection panel 16. Barge assembly 18 is illustrated in FIG. 1 comprising a plurality of barges 20 interconnected together, as discussed in more detail below. Each barge 20 generally includes deck 22, bottom 24 opposite deck 22, side walls 26, front wall 28, and rear wall 30 opposite front wall 28. Side walls 26, front wall 28, and rear wall 30 extend from deck 22 to bottom 24. Additionally, side walls 26, front wall 28, and rear wall 30 each define a plurality of longitudinal cavities 32 extending from deck 22 to bottom 24.

Hydraulic power unit 12 is positioned on deck 22 of a desired barge 20. In one embodiment, hydraulic power unit 12 maintains its position on deck 22 by the force of its weight. In alternate embodiments, hydraulic power unit 12 is secured to deck 22 by various securement devices such as a plurality of fasteners or welding brackets. Thruster unit 14 is connected to a desired barge 20 by connector devices discussed in more detail below. Thruster unit 14 is used to maneuver barge assembly 18 or an individual barge 20 on a waterway and hydraulic power unit 12 powers and controls thruster unit 14.

Although an exemplary arrangement of barge pusher unit 10 is illustrated in FIG. 1 with barge assembly 18 including a plurality of barges 20, it is contemplated that barge pusher unit 10 may be used in accordance with the present disclosure with a single barge 20.

Figure 5:
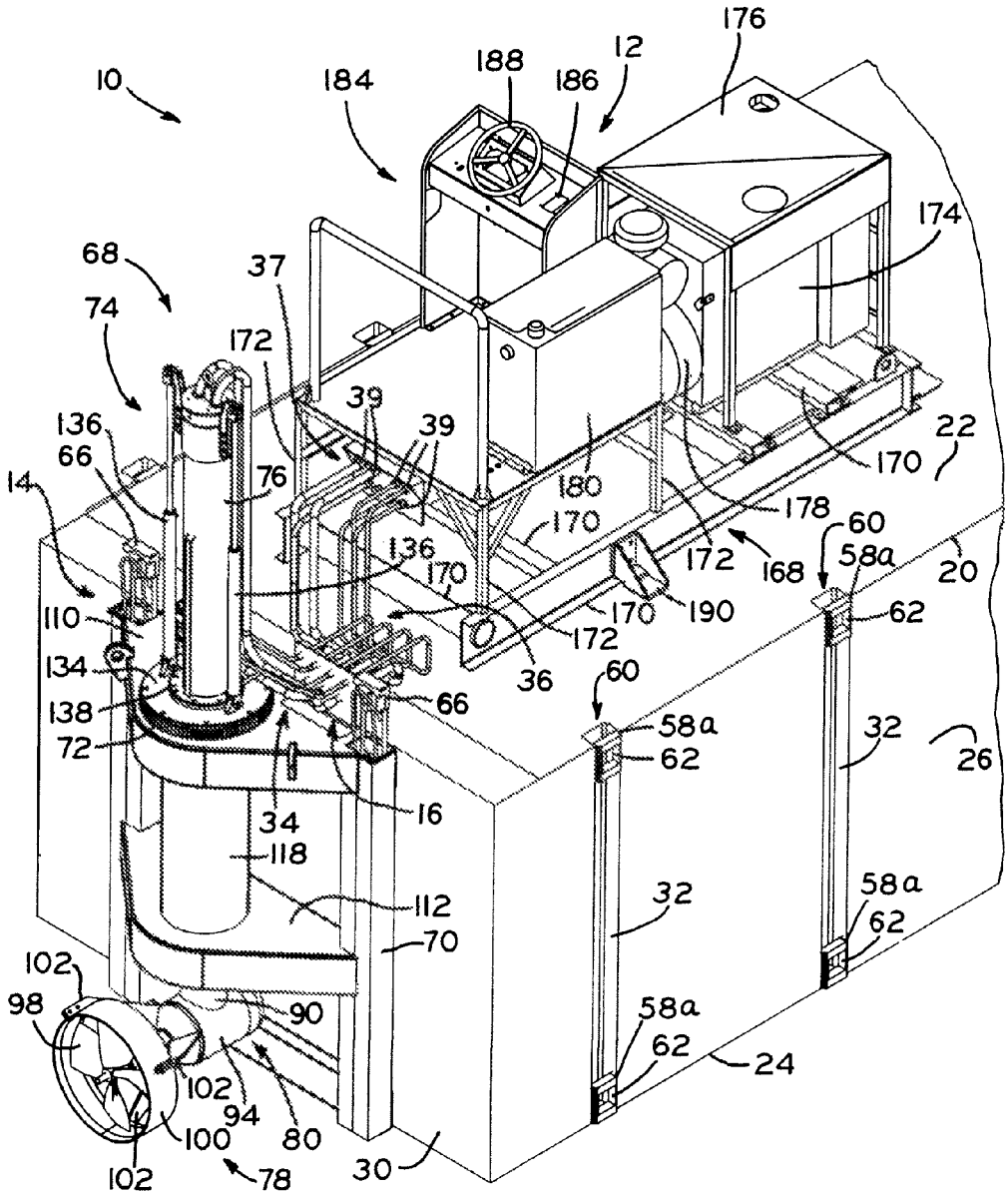
FIG. 5 is an enlarged view of the barge pusher unit of FIG. 1.
Figure 16:
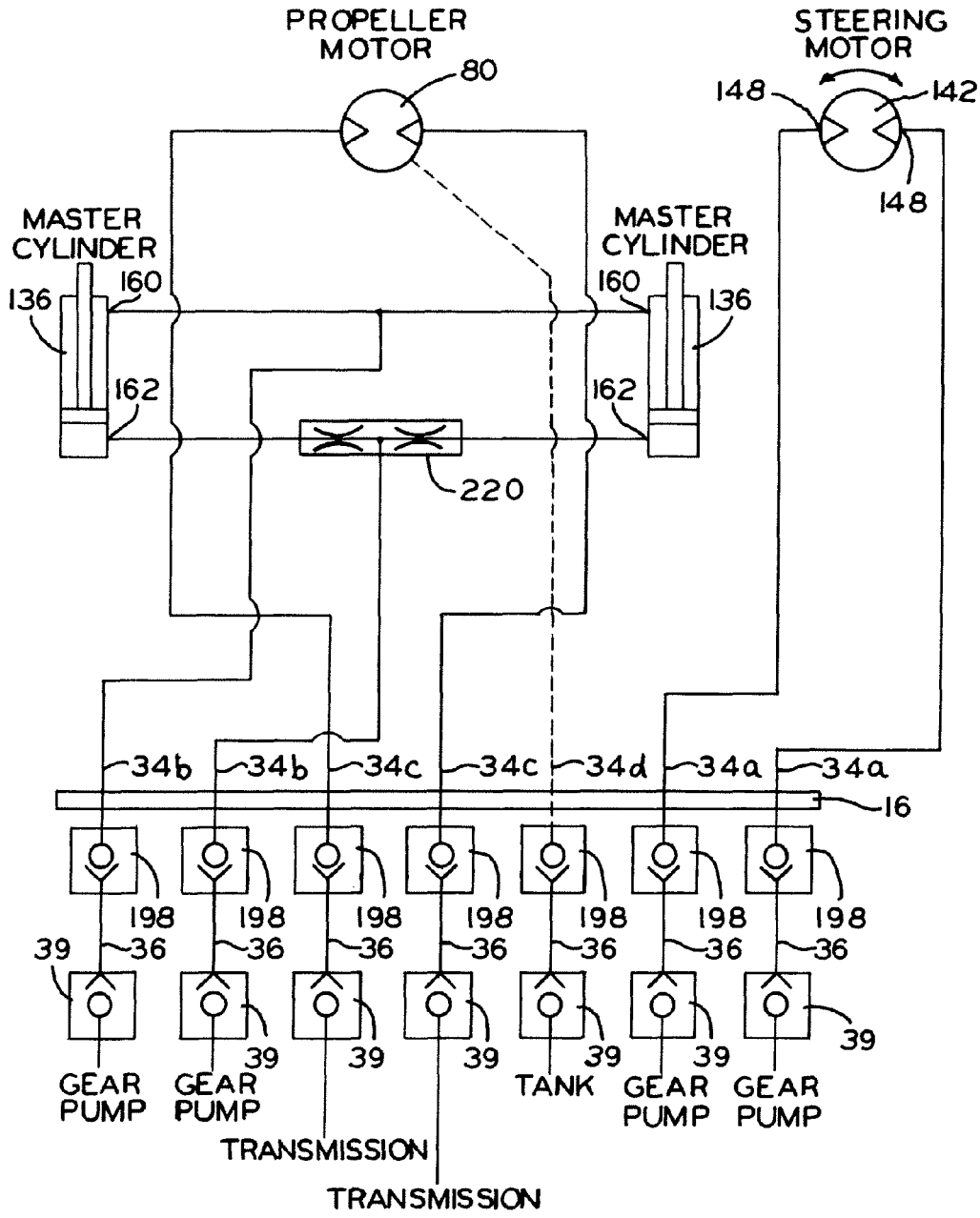
FIG. 16 is a block diagram that schematically illustrates hydraulic connections in accordance with the present disclosure.

Referring to FIG. 5, barge pusher unit 10 includes hydraulic power unit 12 and thruster unit 14. Thruster unit 14 and hydraulic power unit 12 are separate units that are hydraulically connected via a plurality of rigid or flexible hydraulic lines. Referring to FIG. 16, a block diagram is shown that schematically illustrates hydraulic connections in accordance with an exemplary embodiment of the present disclosure, as discussed in further detail below.

Figure 6:
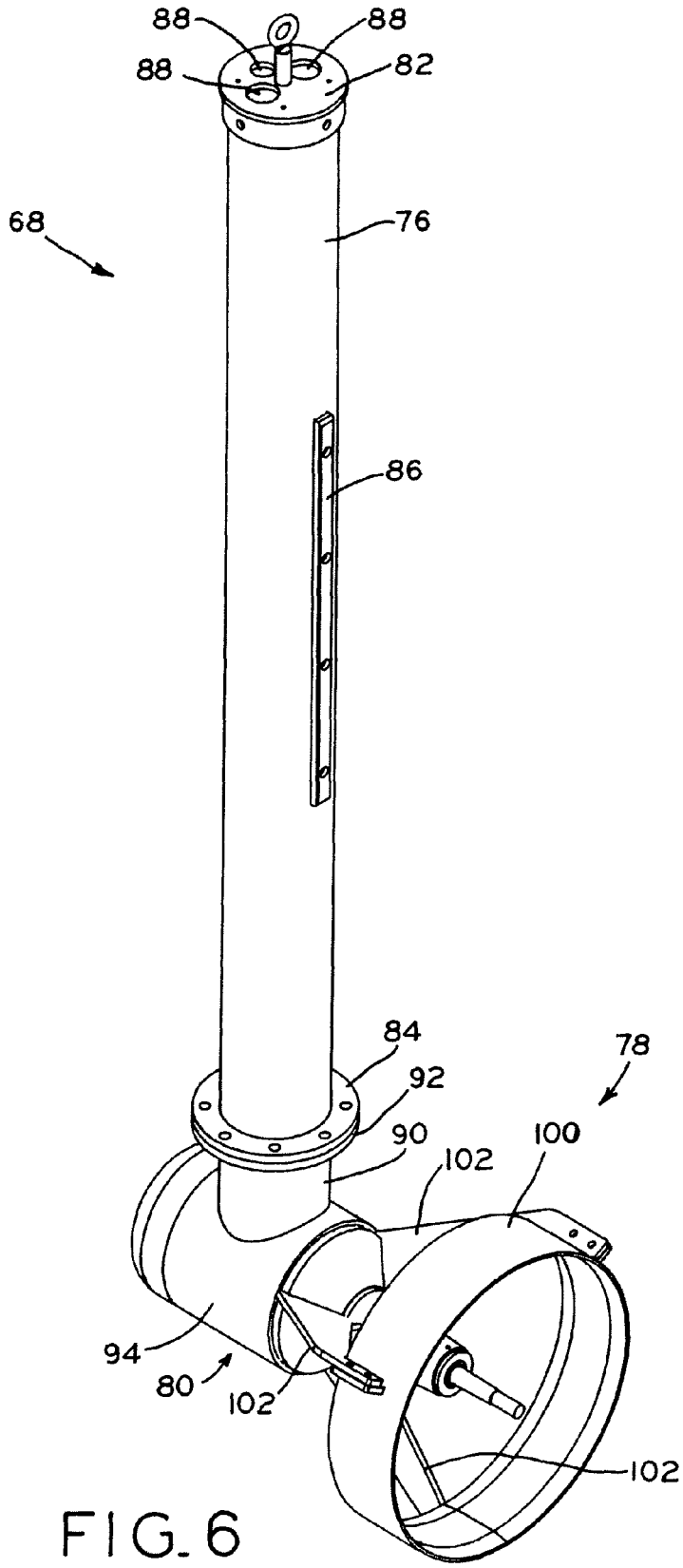
FIG. 6 is a perspective view of an outdrive unit in accordance with the present disclosure.

Thruster unit 14 generally includes outdrive unit 68 (FIG. 6), frame 70 (FIG. 7), turntable bearing assembly 72, and lift assembly 74. Referring to FIGS. 5 and 6, outdrive unit 68 generally includes mast 76, propeller assembly 78, and hydraulic motor 80. In an exemplary embodiment, as illustrated in FIG. 6, cylindrical-shaped mast 76 includes a bulkhead fitting 82 secured thereto at a top end. Bulkhead fitting 82 is fastened to mast 76 and defines three hose openings 88. At a bottom end, mast 76 terminates at mast flange 84. Further, mast 76 includes a first key 86 extending vertically along a longitudinal axis of mast 76 at a front location (FIG. 6) and a back location (FIG. 12), the two keys 86 being spaced approximately 180° degrees from each other. In an exemplary embodiment, mast 76 is made of galvanized steel. Pipe 90 of propeller assembly 78 has a top end terminating at pipe flange 92. Pipe flange 92 is secured to mast flange 84 by various techniques, such as a plurality of fasteners, to secure mast 76 and propeller assembly 78 theretogether. Bottom portion of pipe 90 is welded to hydraulic motor housing 94 which contains hydraulic motor 80. One example of a suitable hydraulic motor 80 is Eaton® Model #5433-174 available from Eaton Corporation. This hydraulic motor is a fixed displacement motor with 5.4 cubic inches of displacement per revolution. It is contemplated that other hydraulic motors can be used in accordance with the present disclosure.

Figure 14:
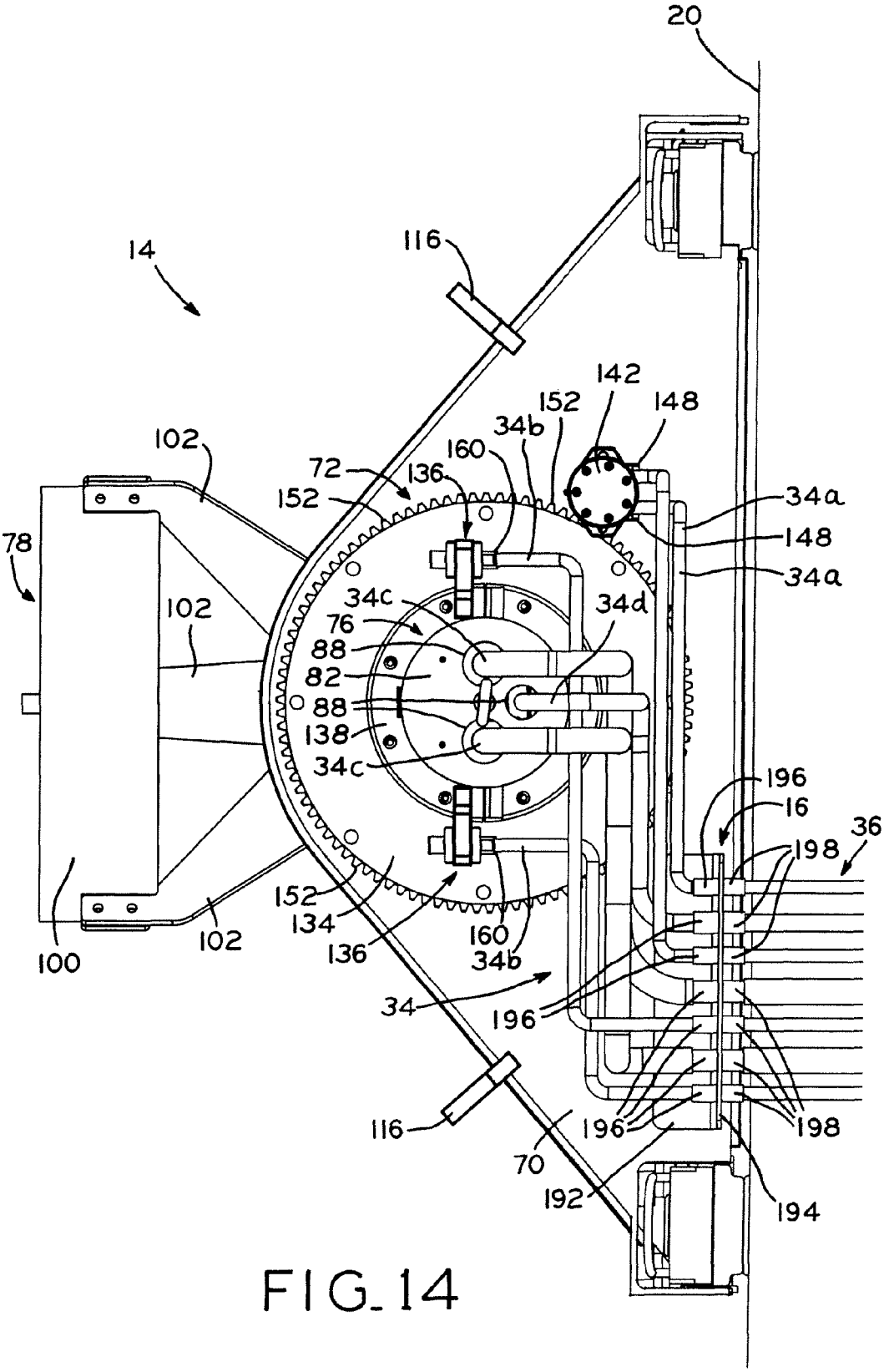
FIG. 14 is a plan view of a thruster unit in accordance with the present disclosure.

Hydraulic motor 80 includes a rotatable drive shaft to which propeller 98 is secured. During operation of hydraulic motor 80, the drive shaft and, correspondingly, propeller 98 are rotated to provide a thrust force that acts to move barge assembly 18. Forward and reverse thrust can be generated by changing the direction of rotation of the drive shaft of hydraulic motor 80. In an exemplary embodiment, ring 100 is provided around propeller 98 to protect propeller 98 from damage. For example, ring 100 protects the blades of propeller 98 from scraping the bottom surface of a waterway. As best shown in FIGS. 6 and 14, three arms 102 connect ring 100 to hydraulic motor housing 94. Arms 102 and ring 100 form a protective structure to keep foreign debris from entering propeller 98. In an exemplary embodiment, ring 100 provides a ducted propeller installation, that when combined with a Kaplan style propeller 98, provides increased efficiency over a non-ducted propeller installation.

Figure 7:
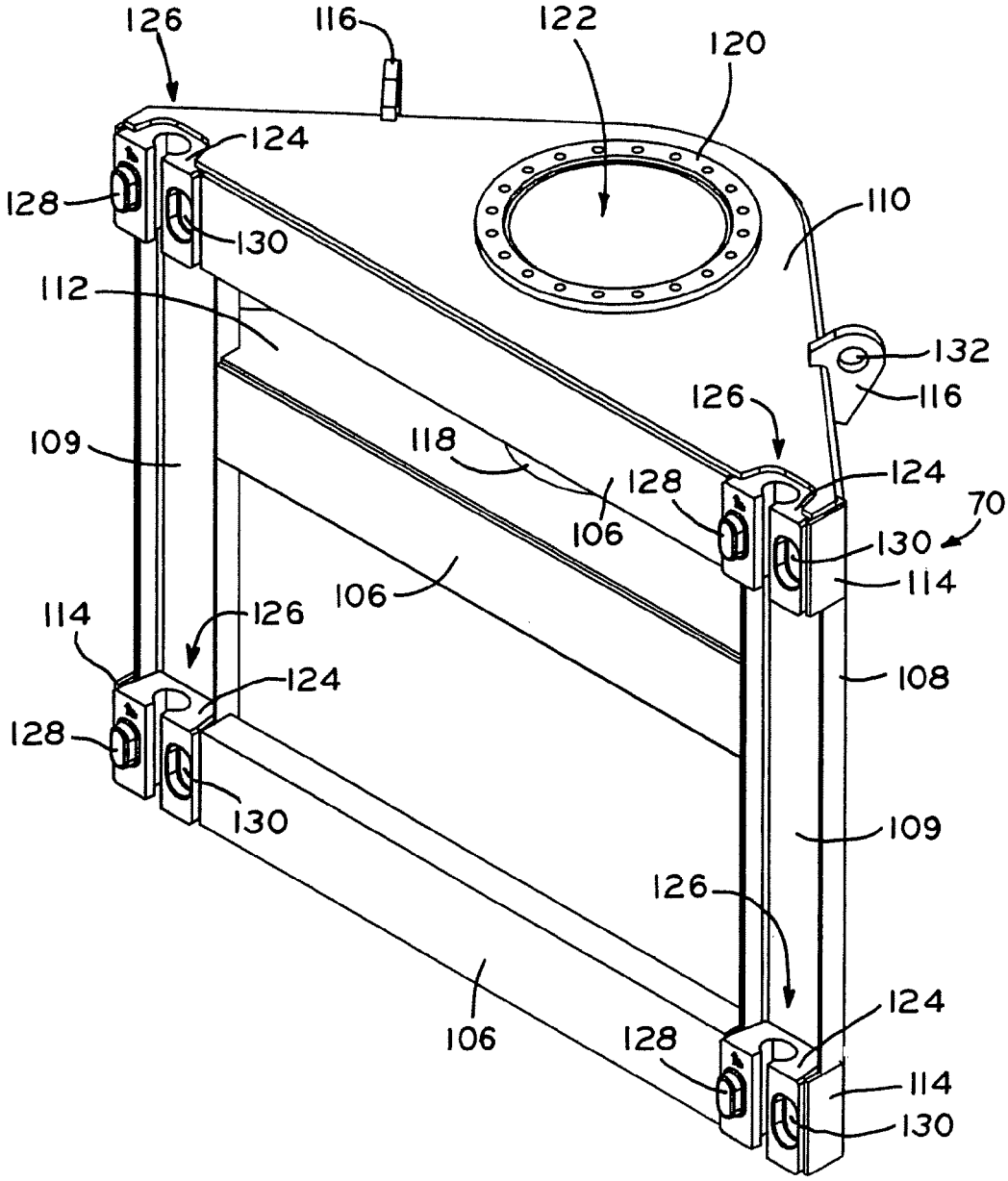
FIG. 7 is a rear perspective view of a frame for connecting the thruster unit of FIG. 6 to the sectional barge assembly of FIG. 1.
Figure 8:
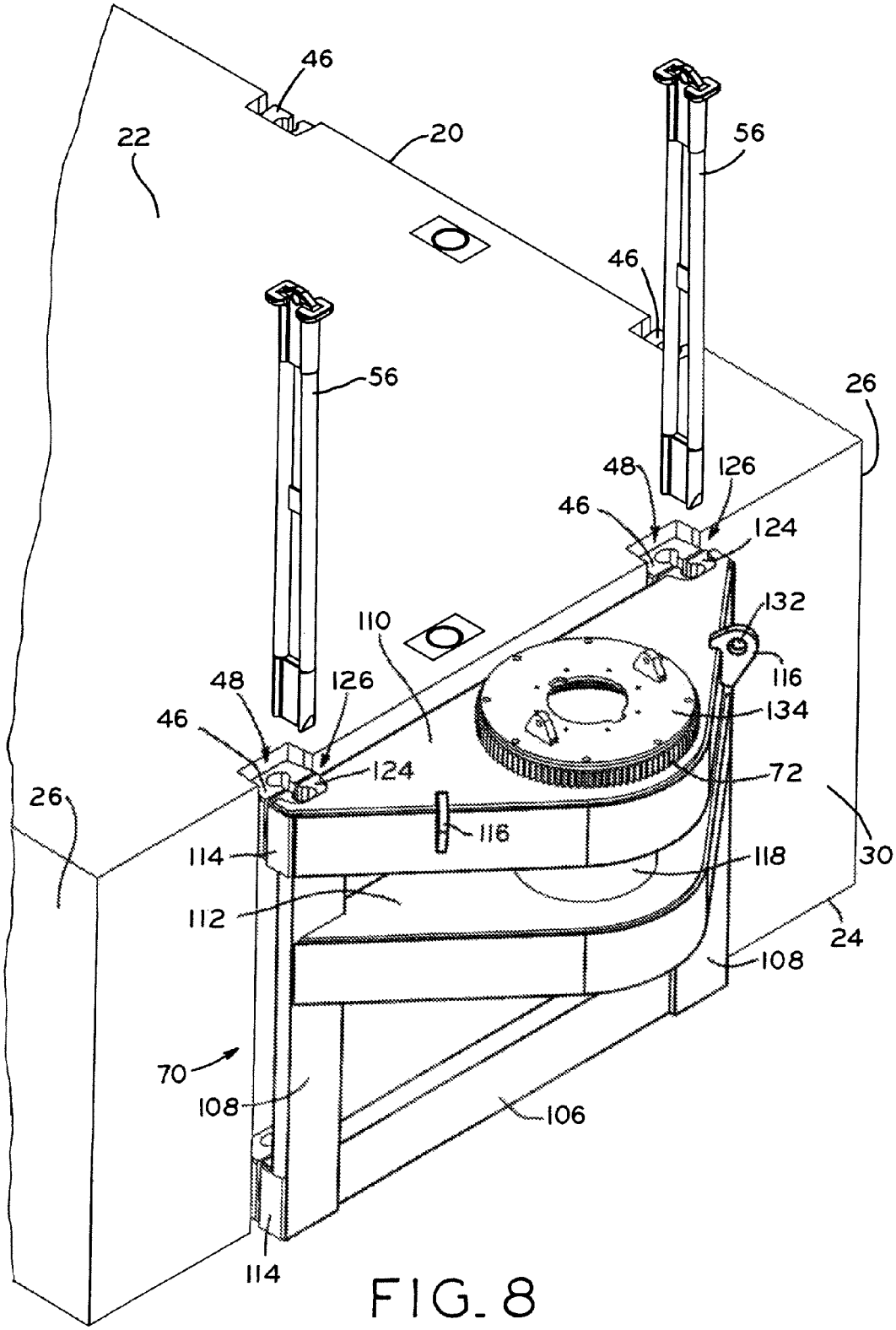
FIG. 8 is an exploded view illustrating one type of connector device for connecting the frame of FIG. 7 to a sectional barge.

According to an exemplary embodiment, outdrive unit 68 is connected to a barge 20 via frame 70 and a connector system as discussed in more detail below. Referring to FIGS. 7 and 8, frame 70 generally includes horizontal members 106, vertical members 108, upper base 110, lower base 112, endplate 114, lifting brackets 116, mast receiving tube 118, and machined flange 120. Horizontal members 106 and vertical members 108 are steel members welded together to form frame 70. Additionally, vertical members 108 each define a vertical member longitudinal cavity 109 extending from the top end of frame 70 to the bottom end of frame 70. Upper base 110 and lower base 112 extend horizontally from a respective horizontal member 106 and have a generally U-shape. The distance between upper base 110 and lower base 112 can vary as illustrated in FIGS. 5 and 7. Both upper base 110 and lower base 112 have a centrally located aperture. Mast receiving tube 118 is welded to upper base 110 and lower base 112 within the centrally located aperture and defines opening 122 for receiving mast 76 therethrough. The length of tube 118 is dependent on the distance between upper base 110 and lower base 112. The distance between upper base 110 and lower base 112 is determined by the barge depth to which frame 70 is attached. For example, industry standard barge depths are 5 feet (60 inches) and 7 feet (84 inches). Mast 76 extends through mast opening 122 of frame 70 and is received within frame 70 such that mast 76 is moveable in a vertical rectilinear direction relative to frame 70. Frame 70 is connected to a desired barge 20 by the same connection system used to interconnect barges 20 as will be discussed below.

Referring to FIG. 7, frame 70 also includes lifting brackets 116 each having eye 132. Lifting brackets 116 are positioned to allow a straight vertical hang of frame 70 for ease of installation of frame 70 to a desired barge 20. Eyes 132 provide attachment points for running wire rope and/or hooks therethrough for attachment to a crane to lift thruster unit 14.

Referring to FIGS. 5 and 8, turntable bearing assembly 72 rotates mast 76 and propeller assembly 78 about a longitudinal axis of mast 76. One example of a suitable turntable bearing assembly 72 is a Kaydon® MTE415 turntable bearing available from Kaydon Corporation. Turntable bearing assembly 72 comprises an outer ring and an inner ring, the outer ring rotatable on ball bearings positioned between the outer ring and the inner ring. The inner ring of turntable bearing 72 is mounted on machined flange 120 (FIG. 7) located on upper base 110 of frame 70. In an exemplary embodiment, turntable bearing 72 is mounted to a surface having a specific degree of flatness to prevent turntable bearing 72 from getting bent or twisted out of shape during use. Accordingly, flange 120 is machined to meet the specific flatness requirement of turntable bearing 72. The inner ring of turntable bearing 72 is mounted on machined flange 120 so that the outer ring of turntable bearing 72 is free to rotate on the ball bearings.

Figure 10A:
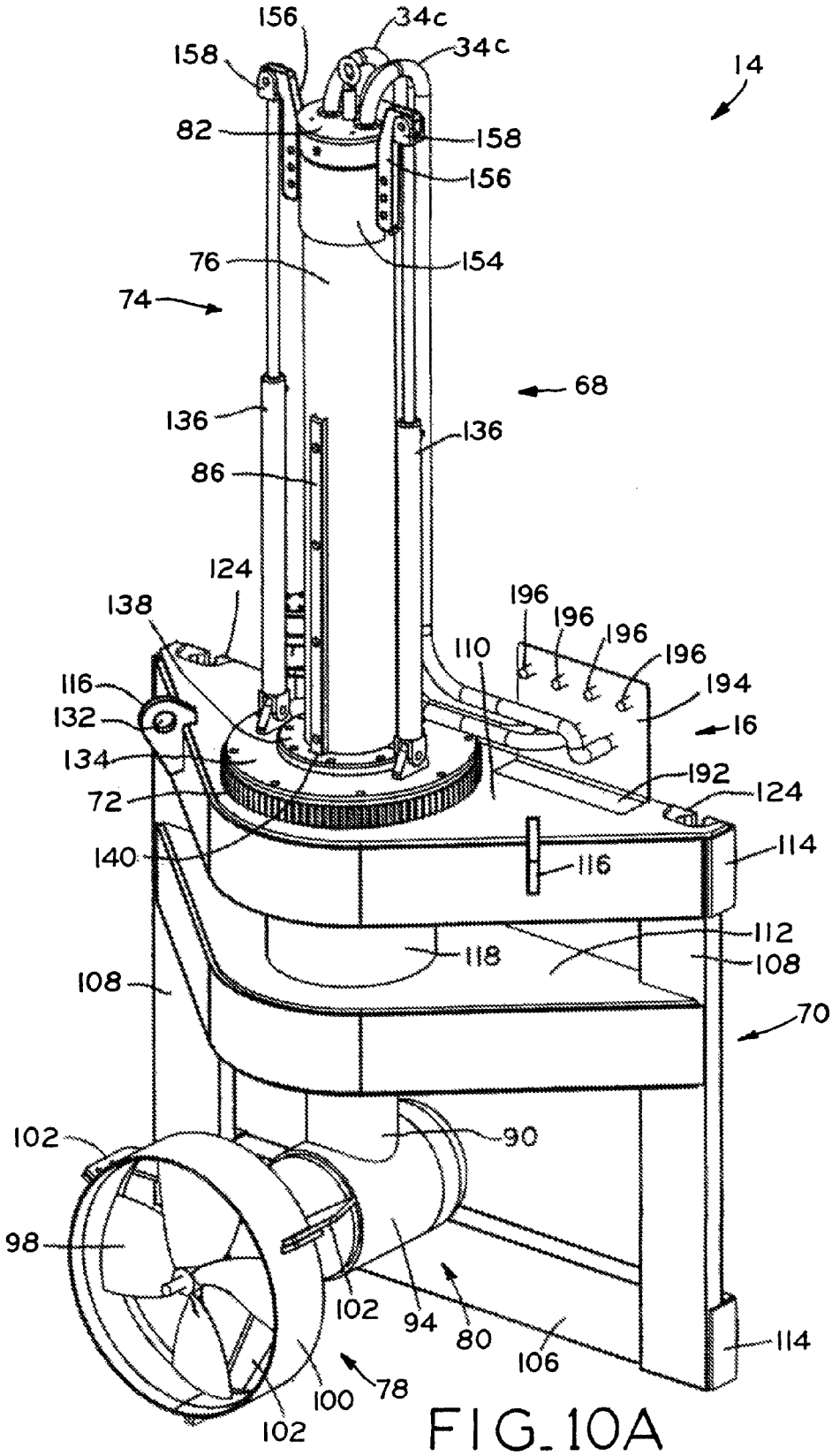
FIG. 10A is a perspective view of a thruster unit in accordance with an exemplary embodiment of the present disclosure.
Figure 10B:
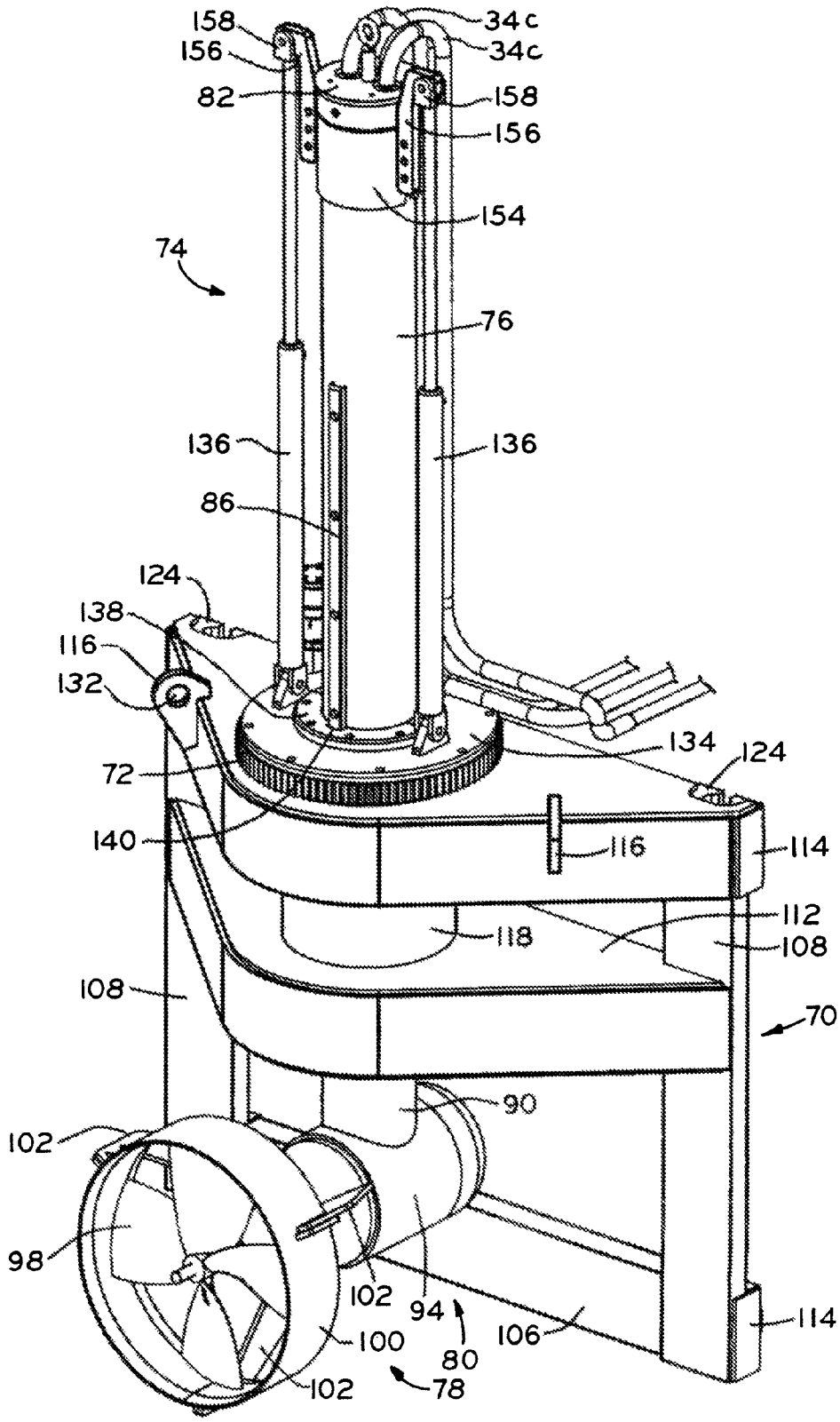
FIG. 10B is a perspective view of a thruster unit in accordance with another exemplary embodiment of the present disclosure.

Referring to FIGS. 10A and 10B, mount plate 134 is secured to the outer ring of turntable bearing 72 by a plurality of fasteners. Mount plate 134 also provides a surface to mount hydraulic cylinders 136 of lift assembly 74 thereon. Next, bushing 138 is mounted to mount plate 134 by a plurality of fasteners. Bushing 138 is preferably made of a plastic material to prevent metal on metal contact with mast 76. This prevents uncontrolled deformation between two metal materials and reduces the wear and heat caused by metal on metal contact. One example of a suitable bushing 138 is a Delrin® keyed bushing available from Meyer Plastics, Inc.

Figure 12:
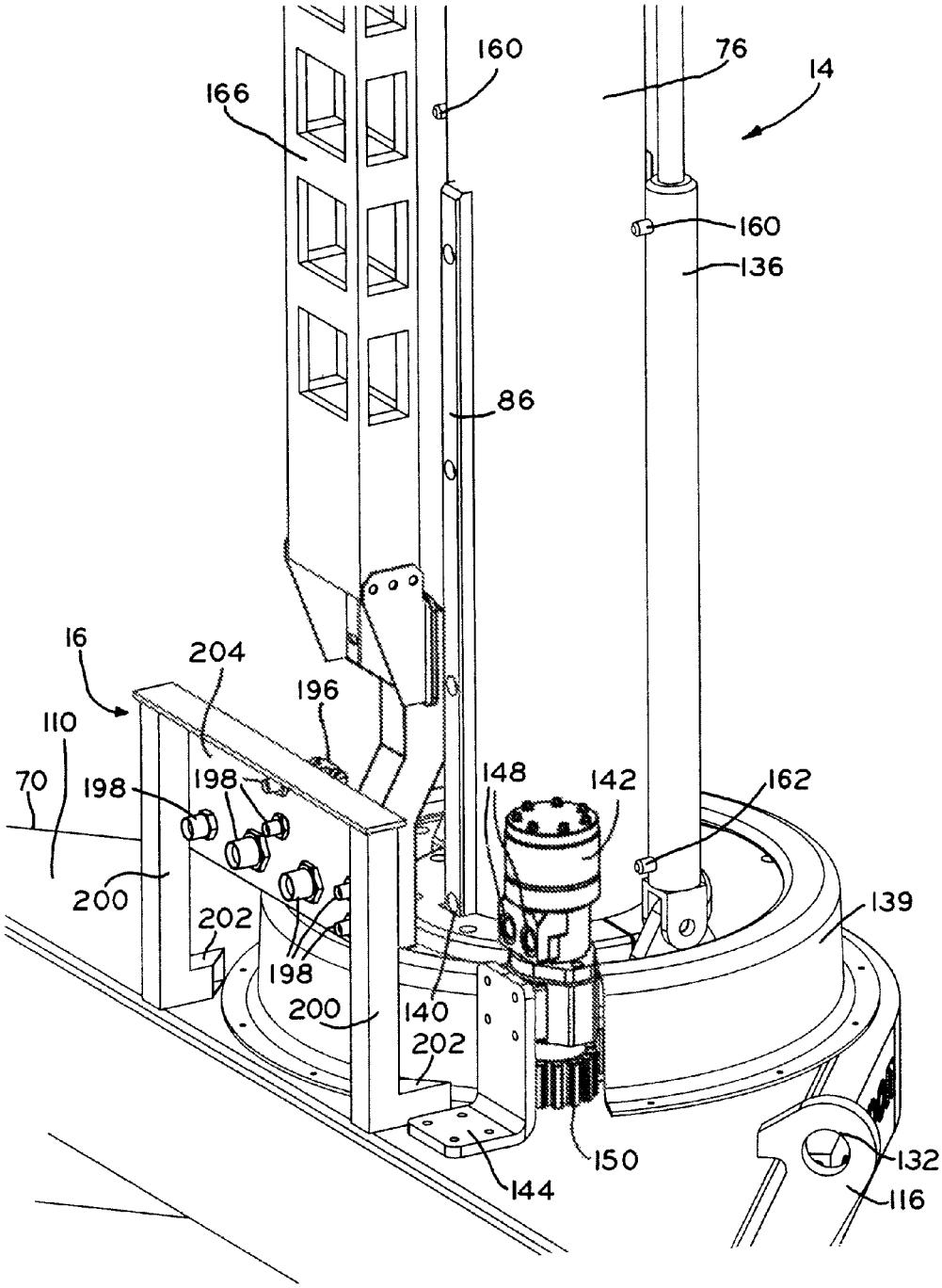
FIG. 12 is an enlarged view of a rear portion of the thruster unit of FIG. 11.

In an exemplary embodiment, bushing 138 includes two female keyways 140 which respectively mate with mast keys 86 located on mast 76. FIGS. 10A and 10B illustrate a first female keyway 140 mated with a first mast key 86 at a front location of mast 76, and FIG. 12 illustrates a second female keyway 140 mated with a second mast key 86 at a rear location of mast 76. When mast 76 is positioned with respect to bushing 138 so that mast keys 86 are mated with respective female keyways 140, then rotation of turntable bearing 72 rotates mast 76 and propeller assembly 78. It is contemplated that other mechanical devices can also be used in accordance with the present disclosure to connect mast 76 and bushing 138.

Figure 11:
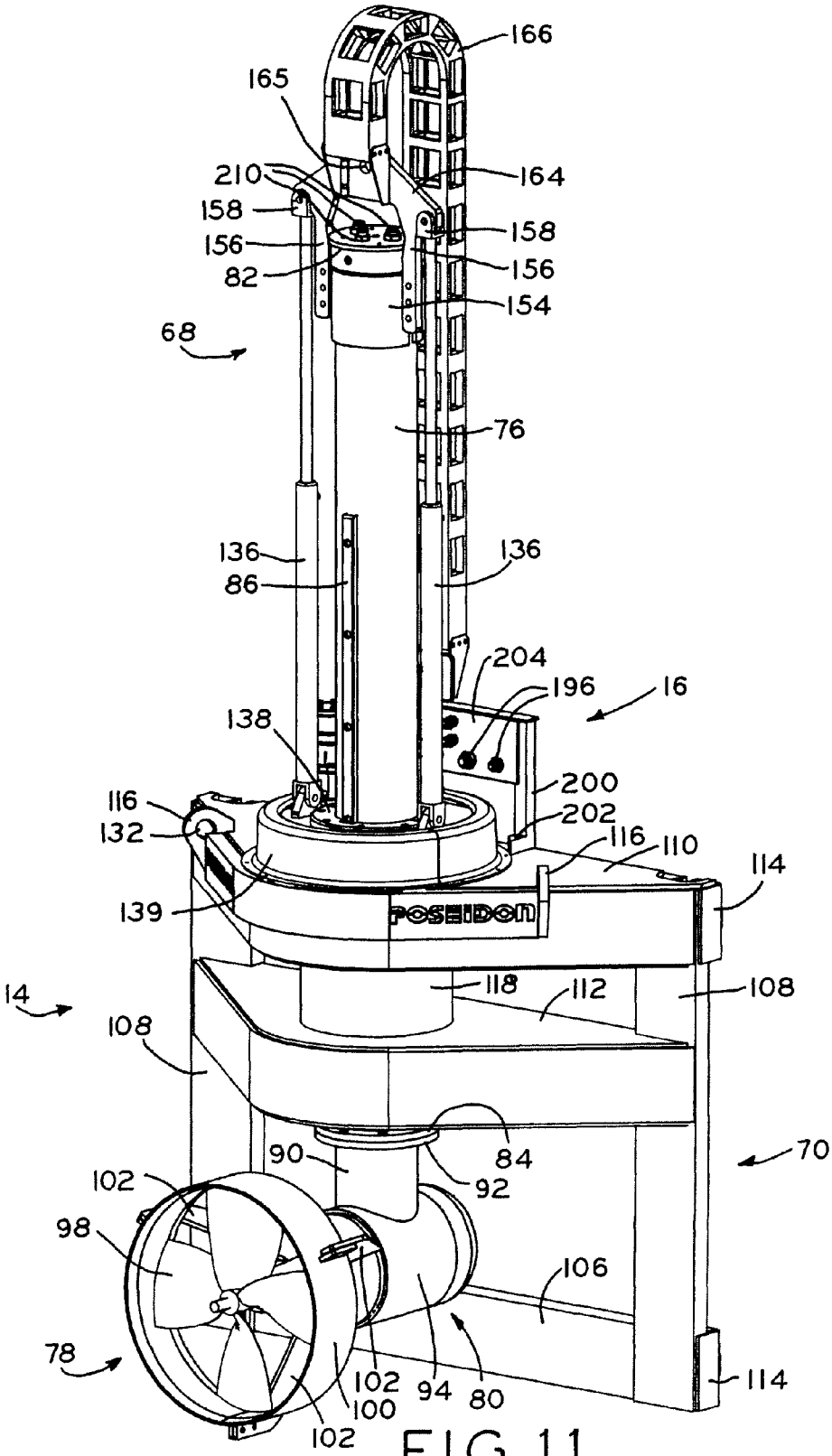
FIG. 11 is another perspective view of the thruster unit.
Figure 13:
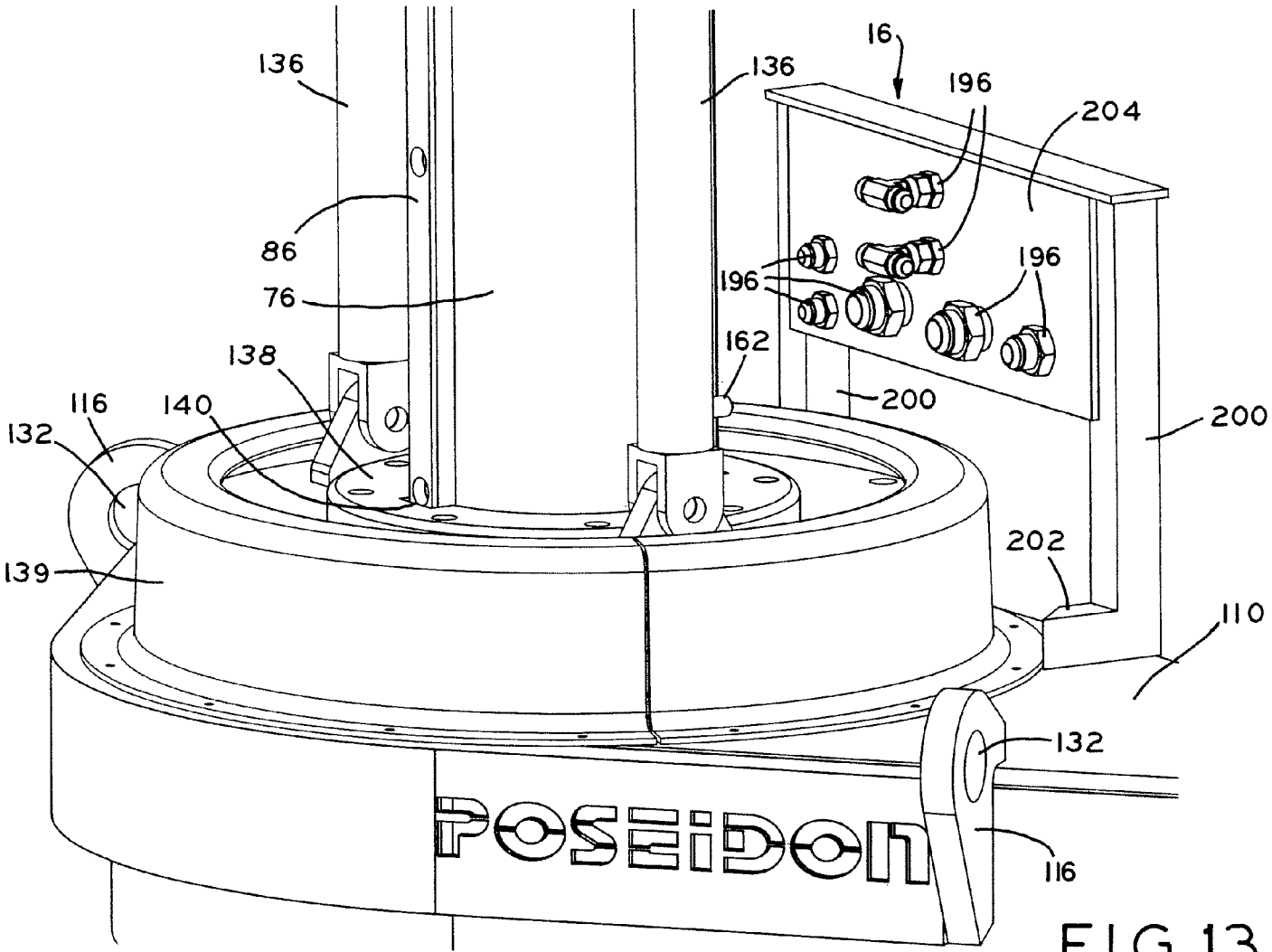
FIG. 13 is an enlarged view of a front portion of the thruster unit of FIG. 11.

Referring to FIGS. 11-13, in one embodiment, protective cover 139 is positioned over turntable bearing assembly 72 and secured to upper base 110 of frame 70. Cover 139 is a plastic safety cover which protects turntable bearing assembly 72 from contamination by dust or other particles. Further, cover 139 prevents unintended interference with turntable bearing assembly 72.

Referring to FIG. 12, steering motor 142 is shown mounted to upper base 110 of frame 70 by steering motor bracket 144. Steering motor bracket 144 is secured to steering motor 142 and upper base 110 by a plurality of fasteners or could be welded in place. Two hydraulic lines 34*a* (FIGS. 14 and 16) run into steering motor hose ports 148 to provide pressurized hydraulic fluid to steering motor 142. Referring to FIG. 16, the two hydraulic lines 34*a* provide for bi-directional motion to operate steering motor 142 in both a clockwise and a counterclockwise direction. Steering motor 142 includes a rotatable steering motor drive shaft to which pinion gear 150 is secured. During operation of steering motor 142, the steering motor drive shaft and, correspondingly, pinion gear 150 are rotated. Pinion gear 150 engages and drives the outer ring of turntable bearing 72 which is cut with gear teeth 152 (FIG. 14) which mate with pinion gear 150. Thus, turntable bearing 72 rotates mast 76 and propeller assembly 78 about a longitudinal axis of mast 76. Advantageously, there is a significant mechanical advantage (6:1) developed due to the relatively large diameter of the turntable gear 152 working in combination with the smaller diameter of pinion gear 150. For example, pinion gear 150 will turn with approximately 300 ft.-lbs. of torque driven by hydraulic steering motor 142, which results in about 1,800 ft.-lbs. of torque at the pivot point of mast 76.

Turntable bearing assembly 72 also supports and rotates the hydraulic components, i.e., hydraulic cylinders 136 of lift assembly 74, which cause vertical rectilinear movement of mast 76 and propeller assembly 78 relative to frame 70. Turntable bearing assembly 72 supports the vertical forces, i.e., weight of the hydraulic components. In addition to supporting the weight, i.e., the axial load, turntable bearing assembly 72 also resists radial and moment loads. The radial load component is generated as a result of the propeller thrust and acts in a direction perpendicular to the axial load. The moment load is a bending moment at turntable bearing 72 which also results from the propeller thrust. This is essentially a torque which twists turntable bearing assembly 72. The ball bearings inside turntable bearing assembly 72 are uniquely suited to support all of these loads simultaneously. Further, turntable bearing assembly 72 transfers these loads to frame 70 and thus into the barge 20 which frame 70 is pinned to.

Referring to FIG. 10A, in an exemplary embodiment, two hydraulic cylinders 136 cause vertical rectilinear movement of mast 76 and propeller assembly 78 relative to frame 70. As previously discussed, hydraulic cylinders 136 are mounted to mount plate 134. Further, hydraulic cylinders 136 are connected to mast 76 by adjustable mast clamp 154. Mast clamp 154 includes two semi-cylindrical shaped members having clamping brackets 156 and clevis fasteners 158 for connecting hydraulic cylinders 136 to mast 76. Once mast clamp 154 is placed in a desired position relative to mast 76, clamping brackets 156 are secured together by a plurality of fasteners to secure mast clamp 154 to mast 76. Before securing together clamping brackets 156, adjustable mast clamp 154 can slide up or down mast 76 longitudinally. This allows for adjustment of the location of mast 76 in its fully up top position and its fully down bottom position.

In an alternate embodiment, as shown in FIG. 11, clamping brackets 156 comprise bracket member 164 having an upper portion which defines eye 165. Eye 165, similar to eyes 132 of lifting brackets 116, provides an attachment point for running wire rope and/or hooks therethrough for attachment to a crane to lift thruster unit 14. Also, as shown in FIG. 11, hydraulic line carrier 166 is used to capture, guide, and protect hydraulic lines 34*c*, 34*d* (FIG. 14) that connect to the top of mast 76 at bulkhead fitting 82.

Referring to FIGS. 12 and 16, each hydraulic cylinder 136 has a top hose port 160 at a top location and a bottom hose port 162 at a bottom location. One hydraulic line 34*b* (FIGS. 14 and 16) connects to each hydraulic cylinder bottom hose port 162 to provide pressurized hydraulic fluid to each hydraulic cylinder 136. In an exemplary embodiment, flow divider 220 (FIG. 16) is provided which ensures that an equal volume of fluid is distributed to each port 162 to keep the travel of hydraulic cylinders 136 synchronized. Further, a first top hydraulic hose (FIG. 16) connects to a top hose port 160 of one of hydraulic cylinders 136. An additional hydraulic hose (FIG. 16) runs from a top hose port 160 of the hydraulic cylinder 136 receiving the first top hydraulic hose and connects to a top hose port 160 of the other hydraulic cylinder 136. This arrangement causes hydraulic cylinders 136 to be controlled at the same rate and same speed and causes vertical movement of mast 76 and propeller assembly 78 from a fully up position to a fully down position and back.

Figure 15:
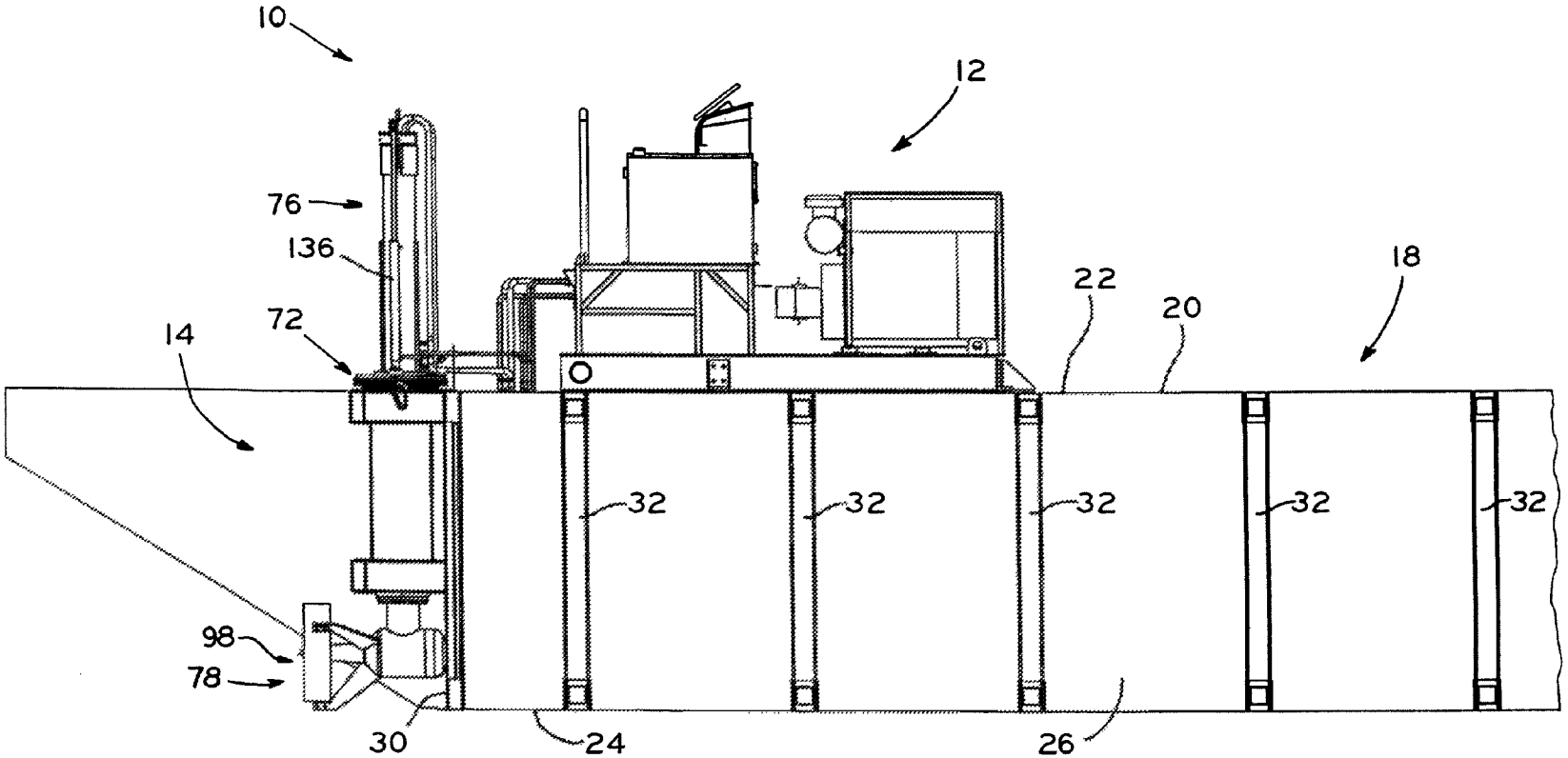
FIG. 15 is a side elevation view of the barge pusher unit and a sectional barge assembly in accordance with the present disclosure.

Referring to FIG. 15, when hydraulic cylinders 136 are in a fully up position propeller 98 is above bottom 24 of barge assembly 18 to protect propeller 98. For example, this ensures that bottom 24 of barge assembly 18 would contact the bottom surface of a waterway first to prevent damage to propeller 98.

When hydraulic cylinders 136 are in a fully down position, propeller 98 is completely below bottom 24 of barge assembly 18 to ensure propeller 98 receives an adequate water flow into its propeller blades to maximize performance. However, if propeller 98 is positioned too far from bottom 24 of barge assembly 18, there is a risk of propeller 98 hitting the bottom surface of a waterway. Should propeller assembly 78 of thruster unit 14 come into contact with a rigid underwater obstruction, advantageously, hydraulic cylinders 136 provide a means of shock absorption. For example, when thruster unit 14 is fully lowered into the water and hydraulic cylinders 136 are fully retracted, if propeller assembly 78 comes into contact with a large rock on a lake bottom that results in a large, immediate upward force on mast 76, hydraulic cylinders 136 will take some of that shock load and will deploy with a spring stiffness that is proportional to the hydraulic pressure inside the hydraulic system at that moment. In other words, hydraulic cylinders 136 will absorb some of the shock energy thereby reducing the stresses on frame 70, Poseidon I connector device 56 (or Poseidon II connector device 66), and barge assembly 18. The shock energy absorbed will manifest itself as a momentary increase in system pressure inside the hydraulic system.

Referring to FIG. 5, hydraulic power unit 12 generally includes frame 168, horizontal base frame members 170, vertical frame members 172, diesel engine 174, engine cover 176, hydraulic pump 178, hydraulic fluid tank 180, hydraulic power unit connection panel 37, a plurality of hydraulic power unit connection panel hydraulic connectors 39, operator helm platform 184, control panel 186, steering wheel 188, and welding brackets 190.

Hydraulic power unit frame 168 forms a base for securing hydraulic power unit 12 to deck 22 of a desired barge 20 and supports diesel engine 174, hydraulic pump 178, hydraulic fluid tank 180, and operator helm platform 184. In an exemplary embodiment, frame 168 includes welding brackets 190 for securing power unit 12 to deck 22.

Diesel engine 174 provides power to hydraulic pump 178, which pressurizes hydraulic fluid from hydraulic fluid tank 180 for delivery to hydraulic motor 80, steering motor 142, and hydraulic cylinders 136 of lift assembly 74 via a plurality of rigid or flexible hydraulic lines, as shown in FIG. 16. Engine cover 176 protects diesel engine 174 from contamination.

An operator of barge pusher unit 10 stands on helm platform 184 to control the various components of barge pusher unit 10. For example, an operator uses controls located on control panel 186 to control the opening and closing of valves to control the delivery of pressurized hydraulic fluid from pump 178 to the various components of thruster unit 14. These controls control the direction and speed of rotation of a rotatable drive shaft of hydraulic motor 80 to which propeller 98 is secured. Additionally, these controls control the direction and speed of rotation of a rotatable steering motor drive shaft of steering motor 142 to control turntable bearing assembly 72 which rotates mast 76 and propeller assembly 78 about the longitudinal axis of mast 76. Finally, controls located on panel 186 control hydraulic cylinders 136 which direct vertical rectilinearly movement of mast 76 and propeller assembly 78 between a fully up top position and a fully down bottom position.

In an exemplary embodiment, hydraulic power unit 12 includes a hydrostatic transmission to adjust the volume of fluid flow supplied to hydraulic motor 80 by controls located on control panel 186.

Further, a directional control valve installed on hydraulic power unit 12 distributes flow volume between steering motor 142 and hydraulic cylinders 136. The directional control valve provides a certain percentage of flow to hydraulic cylinders 136 and a balance of the total flow to steering motor 142. The exact percentage can be adjusted by adjusting the control valve. The directional control valve also protects hydraulic cylinders 136 from uncontrolled cylinder retraction should a hose burst anywhere between hydraulic power unit 12 and thruster unit 14. For example, if an individual hose from hydraulic power unit 12 to hydraulic cylinder 136 should burst, that hydraulic cylinder 136 would lose pressure, but the second hydraulic cylinder 136 would still be able to hold mast 76 up. This is an additional advantage of having two hydraulic cylinders 136.

As previously discussed, thruster unit 14 and hydraulic power unit 12 are separate units that are hydraulically connected via a plurality of rigid or flexible hydraulic lines that carry pressurized hydraulic fluid.

In a first exemplary embodiment, the plurality of hydraulic lines include a plurality of thruster unit hydraulic lines 34 and a plurality of hydraulic power unit hydraulic lines 36 (FIGS. 1, 5, 14 and 16) that are hydraulically connected via thruster unit connection panel 16. Referring to FIGS. 14 and 16, thruster unit hydraulic lines 34, including hydraulic lines 34*a*, 34*b*, 34*c*, 34*d*, carry pressurized hydraulic fluid and are connected to various connectors on connection panel 16 at first line ends, and are connected to various components of thruster unit 14 at second ends opposite the first ends.

For example, in one exemplary embodiment, three hydraulic lines 34*c*, 34*d* (FIGS. 14 and 16) run to hydraulic motor 80. Referring to FIGS. 14 and 16, the two hydraulic lines 34*c* that run from thruster unit connection panel 16 into ports 88 located in bulkhead fitting 82, and down through mast 76 to hydraulic motor 80, are bi-directional hydraulic lines. As discussed above, an operator of barge pusher unit 10 standing on operator helm platform 184 of hydraulic power unit 12 can control the direction of rotation of the drive shaft of hydraulic motor 80. In the first direction of rotation of the drive shaft of the hydraulic motor 80, a first hydraulic line 34*c* carries pressurized hydraulic fluid for delivery to hydraulic motor 80 and a second hydraulic line 34*c* returns hydraulic fluid back to hydraulic pump 178 of hydraulic power unit 12. Next, in the second, opposite direction of rotation of the drive shaft of hydraulic motor 80, hydraulic lines 34*c* swap function, i.e., second hydraulic line 34*c* now carries pressurized hydraulic fluid for delivery to hydraulic motor 80 and the first hydraulic line 34*c* now returns hydraulic fluid back to hydraulic pump 178. Additionally, hydraulic line 34*d* that runs from connection panel 16 into a third port 88 located in bulkhead fitting 82 is an over-pressure hydraulic line. Also, in one exemplary embodiment, two hydraulic lines 34*a* run from thruster unit connection panel 16 and into steering motor 142 via hose ports 148, and hydraulic lines 34*b* run from connection panel 16 and into bottom hose port 162 of each hydraulic cylinder 136.

Power unit hydraulic lines 36 are connected to control valves (not shown) and hydraulic pump 178 via hydraulic connectors 39 located on hydraulic power unit connection panel 37 (FIG. 5) at first line ends, and are connected to various connectors on thruster unit connection panel 16 at ends opposite the first ends. Preferably, hydraulic connectors 39 are hydraulic quick disconnect fittings for connecting hydraulic lines. FIG. 16 schematically illustrates the connection of hydraulic lines 36 from hydraulic connectors 39 located on hydraulic power unit connection panel 37 to hydraulic power unit hydraulic connectors 198 located on thruster unit connection panel 16. Thruster unit lines 34 and power unit lines 36 are in fluid communication via a plurality of hydraulic connectors 196, 198 (FIGS. 12 and 13) in fluid communication through apertures located in thruster unit connection panel 16. Advantageously, thruster unit connection panel 16 and hydraulic power unit connection panel 37 allow quick disconnect fittings to easily couple and decouple hydraulic power unit hydraulic lines 36. This allows thruster unit 14 and hydraulic power unit 12 to be separate from each other, thus making it easier to transport thruster unit 14 and hydraulic power unit 12 to the job site. Additionally, thruster unit connection panel 16 allows thruster unit 14 to be secured to barge assembly 18 at a variety of different positions at varying distances from hydraulic power unit 12. Other advantages of thruster unit connection panel 16 include reducing the likelihood of hydraulic fluid spill by using quick-disconnect fittings and rapid system set-up and tear-down without the use of tools.

Referring to FIGS. 10A and 14, a first embodiment of thruster unit connection panel 16 is illustrated. In this embodiment, panel 16 generally includes a base member 192, vertical support member 194, a plurality of thruster unit hydraulic connectors 196 (FIG. 13), and a plurality of hydraulic power unit hydraulic connectors 198 (FIG. 12). Base member 192 provides a securement element to secure thruster unit connection panel 16 to upper base 110 of frame 70. Vertical support member 194 extends vertically perpendicular to base member 192 and has thruster unit hydraulic connectors 196 (FIG. 13) located on a thruster unit side of vertical support member 194, and hydraulic power unit hydraulic connectors 198 (FIG. 12) located on a hydraulic power unit side of support member 194. Preferably, hydraulic power unit hydraulic connectors 198 are hydraulic quick disconnect fittings for connecting hydraulic lines and connectors 196 are standard fittings.

One such example of hydraulic quick disconnect fittings that can be used in accordance with the present disclosure are the hydraulic quick disconnect fittings available from Stucchi USA, Inc.© of Romeoville, Ill. Hydraulic quick disconnect fittings allow hydraulic power unit hydraulic lines 36 to be quickly and easily connected and disconnected to thruster unit connection panel 16.

Another embodiment of thruster unit connection panel 16 is shown in FIGS. 11-13. In this embodiment, thruster unit connection panel 16 generally includes vertical base members 200, feet 202, and support member 204. Similar to the first embodiment of connection panel 16, this embodiment of connection panel 16 includes thruster unit hydraulic connectors 196 (FIG. 13) located on a thruster unit side of support member 204, and hydraulic power unit hydraulic connectors 198 (FIG. 12) located on a hydraulic power unit side of support member 204. Referring to FIG. 12, two vertical base members 200 include feet 202 which are secured to upper base 110 of frame 70 to secure connection panel 16 to frame 70. Support member 204 is connected to an upper portion of vertical base members 200 and includes thruster unit hydraulic connectors 196 on a first side and hydraulic power unit hydraulic connectors 198 on an opposite second side.

In both embodiments of connection panel 16 discussed above, thruster unit hydraulic lines 34 are connected to thruster unit hydraulic connectors 196 of connection panel 16, and hydraulic power unit hydraulic lines 36 are connected to hydraulic power unit hydraulic connectors 198. Hydraulic lines 34 and hydraulic lines 36 are in fluid communication with each other via apertures located in support members 194, 204. In an exemplary embodiment, both thruster unit hydraulic lines 34 and hydraulic power unit hydraulic lines 36 will be covered in a protective sheath enclosing all hydraulic lines.

In a second exemplary embodiment, as illustrated in FIG. 11, hydraulic connectors 210 are located on bulkhead fitting 82 at the top of mast 76. This arrangement allows hydraulic lines 34*c* (FIG. 10B) to run from power unit 12 directly to hydraulic connectors 210 at the top of mast 76, and down mast 76 to hydraulic motor 80, without having to first connect to thruster unit connection panel 16, as illustrated in FIG. 10B. Alternatively, hydraulic connectors can be located at steering motor hose ports 148 to allow hydraulic lines to run from power unit 12 to the hydraulic connectors at steering motor hose ports 148, and to steering motor 142, without having to first connect to thruster unit connection panel 16. Similarly, hydraulic connectors can be located at hose ports 160, 162 of hydraulic cylinders 136 to allow hydraulic lines to run directly from power unit 12 to hydraulic connectors at ports 160, 162, and to hydraulic cylinders 136, without having to first connect to thruster unit connection panel 16. In such embodiments, at least one of the hydraulic connections between power unit 12 and either hydraulic motor 80, steering motor 142, or hydraulic cylinders 136 is via thruster unit connection panel 16. In another embodiment, at least two of these connections are via thruster unit connection panel 16. In an exemplary embodiment, hydraulic connectors 210, similar to hydraulic connectors 196, 198 of connection panel 16, are hydraulic quick disconnect fittings for connecting hydraulic lines.

In another exemplary embodiment, as illustrated in FIG. 1, additional thruster unit 38 is secured to a second barge 20. In such an embodiment, additional thruster unit 38 is hydraulically connected to hydraulic power unit 12 by thruster unit hydraulic lines 40 that connect with an additional set of hydraulic power unit hydraulic lines 42 via additional thruster unit connection panel 44 mounted on additional thruster unit 38. In such an embodiment, hydraulic power unit connection panel 37 of hydraulic power unit 12 is sized to have enough connections to support two thruster units 14, 38. Additional thruster unit 38 provides barge pusher unit 10 with optimal turning power for maneuvering large sectional barge assemblies. In an alternative embodiment, additional thruster unit 38 can have hydraulic connectors, similar to hydraulic connectors 210, located at the top of its mast to allow hydraulic lines to run from hydraulic pump 178 to the hydraulic connectors at the top of its mast without having to first connect to additional thruster unit connection panel 44. In another embodiment, an additional hydraulic power unit 12 could be utilized to power additional thruster unit 38. In yet another embodiment, a plurality of hydraulic power units could be utilized to power numerous thruster units.

FIG. 16 illustrates the hydraulic system employed in an exemplary barge-thruster arrangement in accordance with the present disclosure.

Figure 2:
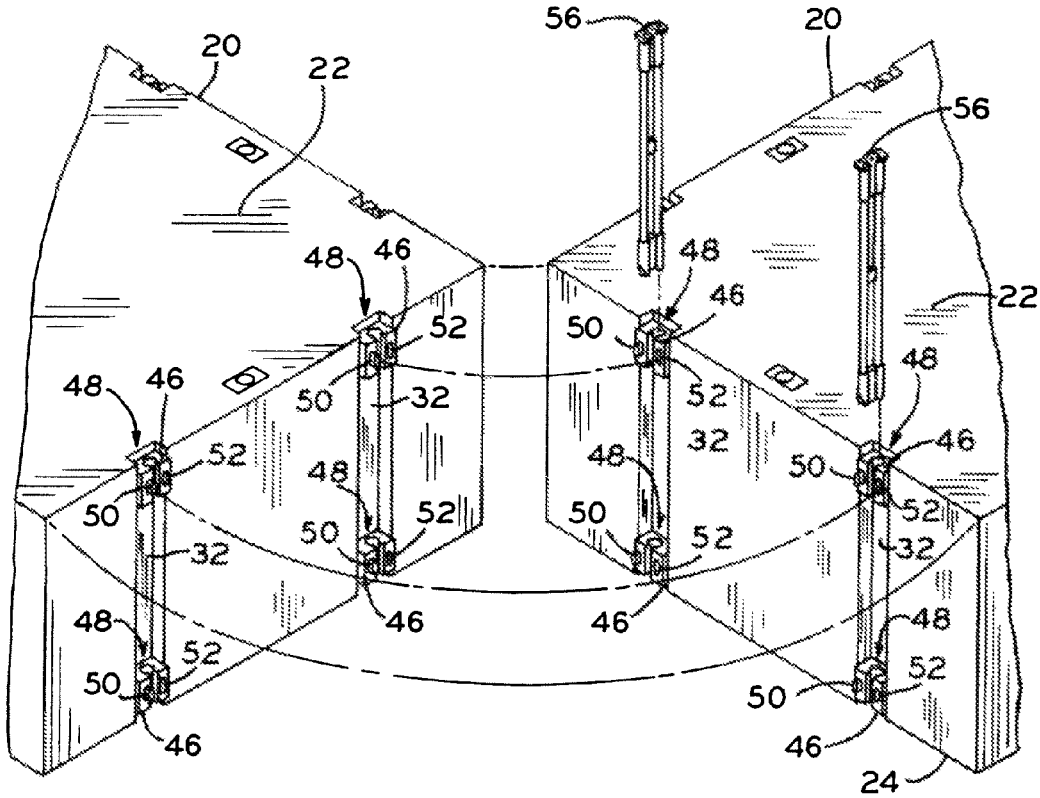
FIG. 2 is an exploded fragmentary view illustrating a first sectional barge and a second sectional barge.
Figure 3:
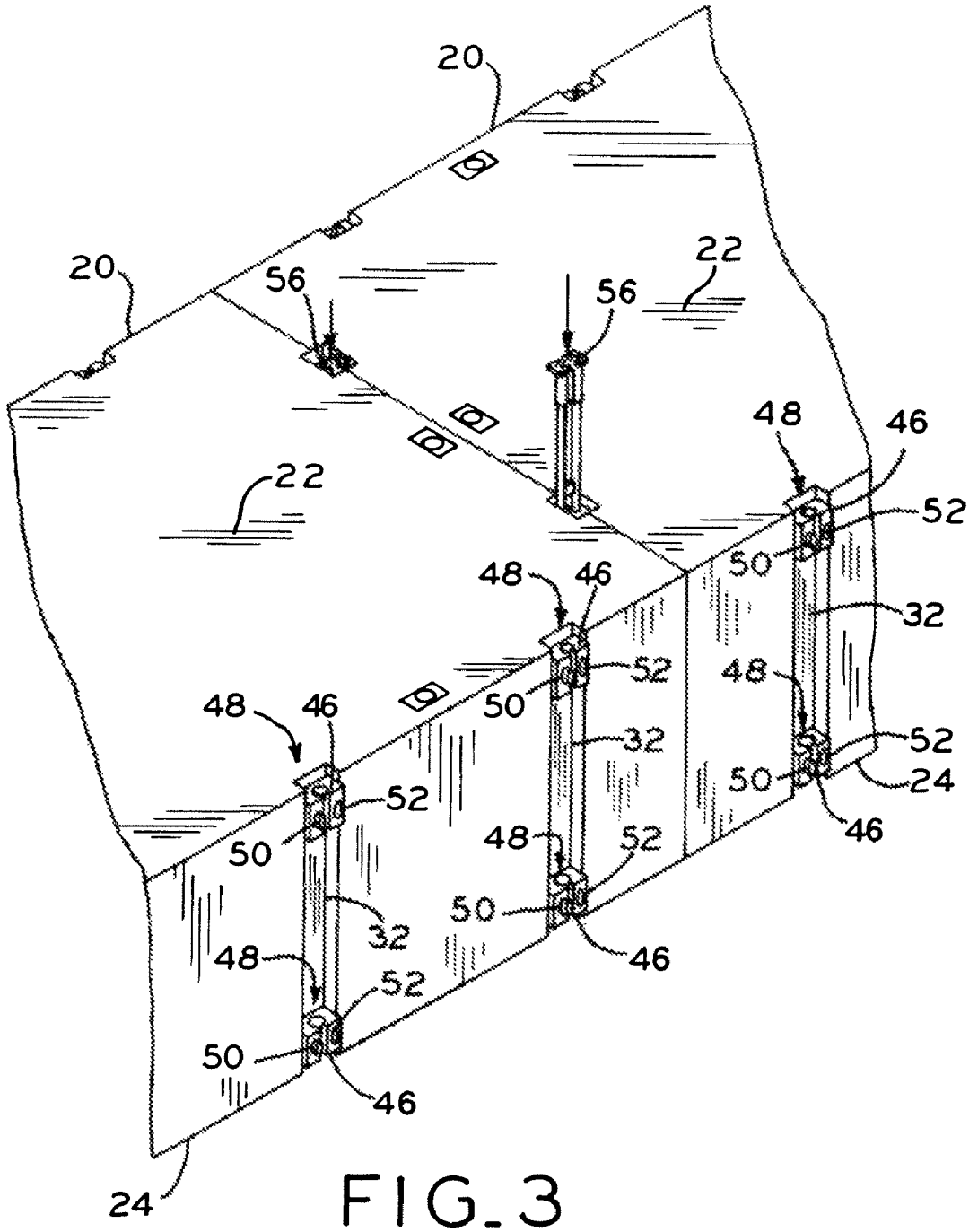
FIG. 3 is a perspective view of the first sectional barge of FIG. 2 connected with the second sectional barge of FIG. 2.

As previously discussed, frame 70 is connected to a desired barge 20 by the same connection systems used to interconnect barges 20. Referring to FIGS. 2-4, two universal connection systems are disclosed for interconnecting barges 20. A first embodiment illustrated in FIGS. 2 and 3 is the Poseidon I connection system compatible with Rendrag® style barges available from Poseidon Barge Corporation of Fort Wayne, Ind. The second embodiment illustrated in FIG. 4 is the Poseidon II connection system compatible with Flexifloat® style barges, also available from Poseidon Barge Corporation. Both the Poseidon I connection system and the Poseidon II connection system are universal connection systems associated with construction barges.

Referring to FIGS. 2, 3 and 8, the Poseidon I connection system generally includes a plurality of keyhole-shaped connection elements 46 each defining a female receiving cavity 48. Connection elements 46 are made of a steel or similar material and are welded to barge 20 within longitudinal cavities 32. In an exemplary embodiment, a first connection element 46 is welded to barge 20 within longitudinal cavity 32 at a top position adjacent to deck 22 and a second connection element 46 is welded to barge 20 within longitudinal cavity 32 at a bottom position adjacent bottom 24. In such an arrangement, each longitudinal cavity 32 of barge 20 includes a first and second connection element 46 providing barge 20 with a plurality of connection elements 46 spaced along its periphery. In alternative embodiments, connection elements 46 may be positioned in other arrangements relative to barge 20.

Each connection element 46 has a protrusion 50 located on a first outer portion and defines a recess 52 on a second outer portion. As illustrated in FIG. 2, protrusions 50 of connection elements 46 on a first barge 20 are sized to be received in respective recesses 52 of connection elements 46 on a second barge 20. After aligning and positioning barges 20 together by cooperating respective protrusions 50 and recesses 52 of connection elements 46, a plurality of Poseidon I male connector devices 56 are used to interconnect the barges 20 together. Each Poseidon I connector device 56 has a dog bone shaped cross-section and slides through female receiving cavities 48 of adjacent connection elements 46 to interlock respective connection elements 46 on a first barge 20 and connection elements 46 on a second barge 20. Connector device 56 slides along the longitudinal axis of longitudinal cavity 32. The Poseidon I connection system can be used to interconnect as many barges 20 as desired to form a barge assembly 18.

The second exemplary embodiment for interconnecting barges 20, the Poseidon II connection system, is illustrated in FIGS. 4 and 5. In this embodiment, the Poseidon II connection system generally includes two types of Poseidon II connection elements 58*a*, 58*b*. Poseidon II connection elements 58*a*, 58*b* are made of a steel or similar material and are welded to barge 20. A first type of connection element 58*a* defines a female receiving cavity 60 and a recess 62, and is welded to barge 20 within longitudinal cavity 32. In an exemplary embodiment, a first connection element 58*a* is welded to barge 20 within longitudinal cavity 32 at a top position adjacent to deck 22 and a second connection element 58*a* is welded to barge 20 within longitudinal cavity 32 at a bottom position adjacent to bottom 24. A second type of connection element 58*b* includes protrusion 64 that is sized to be received in respective recesses 62 of the first type of connection element 58*a*. After aligning and positioning barges 20 together by respectively cooperating protrusions 64 of the second type of connection elements 58*b* with recesses 62 of the first type of connection elements 58*a*, a plurality of Poseidon II male connector devices 66 are used to interconnect barges 20 together. Connector devices 66 act as a guillotine component which captures protrusion 64 aligned within recess 62 of respective connection elements 58*a*, 58*b* to provide a secure connection between barges 20. Similar to the Poseidon I connection system discussed above, the Poseidon II connection system can be used to interconnect as many barges 20 as desired to form a barge assembly 18.

Frame 70 can be secured to barge 20 by either a Poseidon I connection system or a Poseidon II connection system. For example, frame 70 can have either Poseidon I type connection elements or Poseidon II type connection elements welded thereto. Referring to FIG. 7, frame connection elements 124 are welded to frame 70 within longitudinal cavity 109 at a top position and at a bottom position. Endplates 114 are welded to vertical members 108 and connection elements 124 to strengthen frame 70. In one embodiment, frame connection elements 124 comprise a Poseidon I connection system including female receiving cavity 126, protrusion 128, and recess 130. As shown in FIGS. 7 and 8, protrusions 128 of frame connection elements 124 are sized to be received in respective recesses 52 of a Poseidon I connection element 46 (FIGS. 2 and 3). In the same manner as discussed above regarding using Poseidon I connector devices 56 to interconnect a first barge 20 and a second barge 20 together, Poseidon I connector devices 56 can also be used to connect frame 70 to a desired barge 20.

Figure 9:
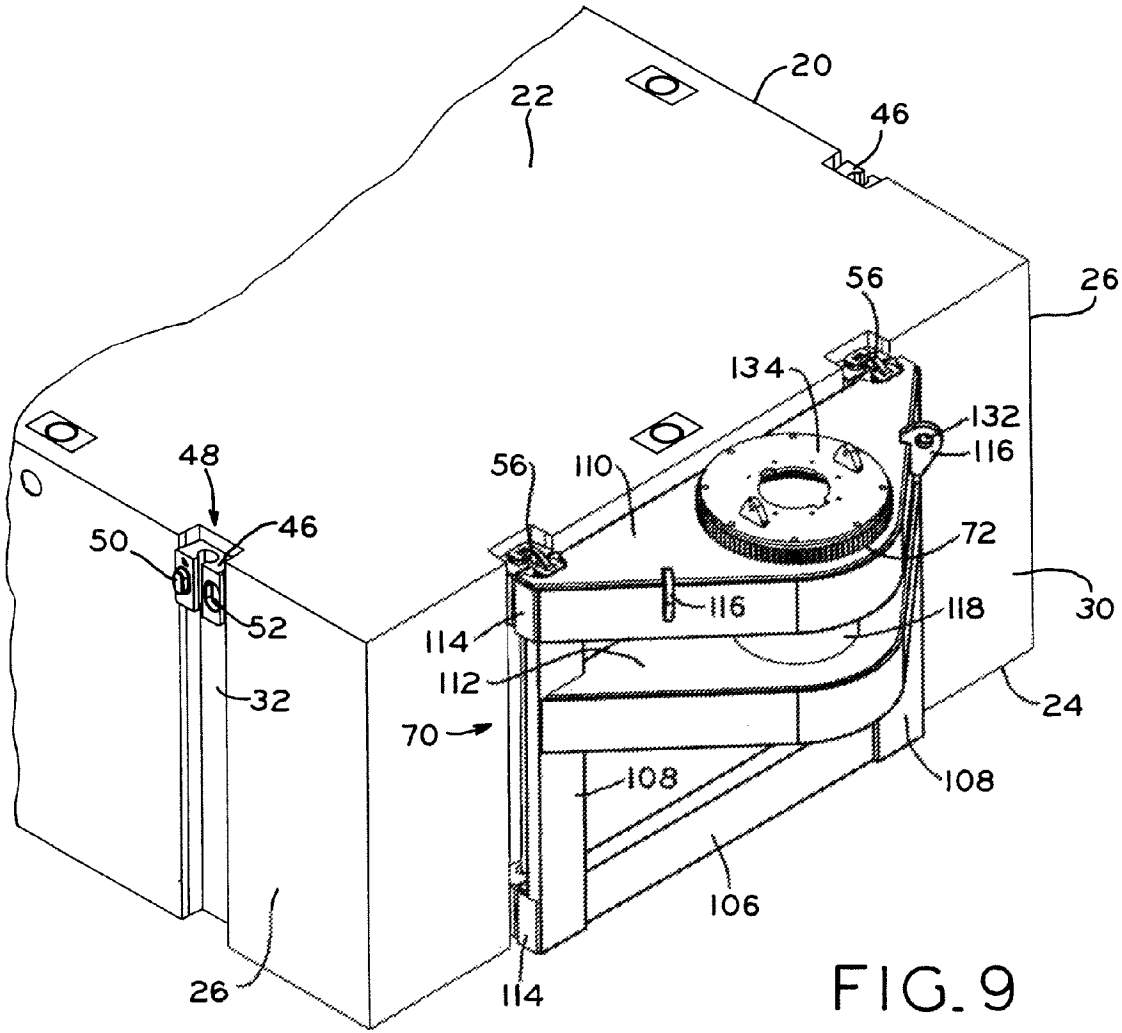
FIG. 9 is a perspective view of the frame of FIG. 7 connected to a sectional barge.

Referring to FIGS. 8 and 9, frame 70 is illustrated positioned to barge 20 with frame connecting elements 124 of frame 70 aligned with Poseidon I connection elements 46 of barge 20, respectively. After frame 70 is properly aligned with barge 20, a Poseidon I connector device 56 is used to interconnect frame 70 and barge 20. Accordingly, Poseidon I connector devices 56 can be used to interconnect frame 70 and barge 20, and to interconnect barges 20 as previously discussed. Advantageously, the system of the present disclosure only requires one type of connection device to interconnect a plurality of barges 20 and to connect frame 70 of thruster unit 14 to a desired barge 20. Additionally, frame 70 can be connected to any location on barge 20. In one embodiment, frame 70 can be connected to eight possible locations on a twenty-foot barge. In another embodiment, frame 70 can be connected to sixteen possible locations on a forty-foot barge In an alternate embodiment, frame 70 can include a Poseidon II connection system that is compatible with Poseidon II connection elements 58*a*, 58*b* secured to a barge 20, as illustrated in FIG. 4, to secure frame 70 to a desired barge 20. In this embodiment, frame 70 having Poseidon II connection elements and barge 20 having Poseidon II connection elements 58*a*, 58*b* are interconnected together in the same manner as described previously with respect to using a Poseidon II connection system to interconnect sectional barges 20.

Although two exemplary arrangements of interconnecting barges 20, and frame 70 to a desired barge 20, are discussed above, it is contemplated that other connecting devices can be used in accordance with the present disclosure to interconnect as many barges 20 as desired to form a barge assembly 18 and to interconnect frame 70 to a desired barge 20.

While this invention has been described as having exemplary designs, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. In combination:

a sectional barge assembly, comprising:

at least a first barge and a second barge, said barges each having an upper exposed deck;

a plurality of first connection elements on at least one side wall and at least one end wall of said first barge;

a plurality of second connection elements on at least one side wall and at least one end wall of said second barge aligned with said plurality of first connection elements; and connector devices of a given configuration interconnecting some of said plurality of first connection elements and said plurality of second connection elements on said side wall or said end wall, respectively, to thereby connect said first barge and said second barge together;

a non-buoyant thruster unit for maneuvering said sectional barge assembly, said thruster unit comprising:

a frame;

a hydraulic motor and a propeller drivingly connected to said motor, whereby said propeller provides a thrust force that acts to move said sectional barge assembly;

a thruster unit connection element on said frame compatible for connection with said plurality of connection elements, a connector device of said given configuration interconnecting said thruster unit connection element to an available one of said plurality of connection elements on said side wall and said end wall of one of said barges to thereby connect said thruster unit to said sectional barge assembly, said thruster unit thereby being detachably connected to a side wall or an end wall of one of said barges and vertically supported thereon; and a power unit comprising an engine and a hydraulic pump driven by said engine and hydraulically connected to said thruster unit motor, said power unit supported on the upper deck of one of said barges.

2. The combination of claim 1, wherein:

said thruster unit comprises a mast slidably connected to said frame, said mast slidable vertically rectilinearly between a top position and a bottom position;

said propeller and said motor forming an assembly connected to said mast;

and including a raising and lowering mechanism for controlling vertical rectilinear sliding of said mast relative to said frame between said top position and said bottom position, with said mast in said top position said propeller is above said bottom surface of said barge assembly, and with said mast in said bottom position said propeller is just below said bottom surface of said barge assembly.

3. The combination of claim 2, wherein said mast is adjustably connected to said raising and lowering mechanism to adjust to barges of different heights.

4. The combination of claim 2, wherein said raising and lowering mechanism comprises at least one hydraulic cylinder connected to said frame.

5. The combination of claim 2, wherein said thruster unit further comprises a turntable bearing assembly rotatably connected to said frame, said mast engaged with said turntable bearing assembly for rotation therewith.

6. The combination of claim 5, further comprising:

a steering motor mounted on said frame; and a gear driven by said steering motor and drivingly connected to said turntable bearing assembly, whereby said steering motor drives said gear which rotates said turntable bearing assembly.

* * * * *